US005841390A

United States Patent [19]

Tsui

[11] Patent Number: 5,841,390

[45] **Date of Patent: *Nov. 24, 1998**

[54] REMOTE TRANSMITTER-RECEIVER CONTROLLER FOR MULTIPLE SYSTEMS

[76] Inventor: Philip Y. W. Tsui, 3513 Ingram Rd., Mississauga, Ontario, Canada, L5L 4M4

[ * ] Notice: The term of this patent shall not extend beyond the expiration date of Pat. No. 5,680,134.

[21] Appl. No.: 823,789

[22] Filed: Mar. 24, 1997

Related U.S. Application Data

[63] Continuation-in-part of Ser. No. 583,883, Jan. 11, 1996, Pat. No. 5,680,134, which is a continuation of Ser. No. 270,374, Jul. 5, 1994, abandoned.

[51] Int. Cl.[6] ..... G08C 19/12

[52] U.S. Cl. ..... 341/173; 341/176; 340/825.31; 340/825.73

[58] Field of Search ..... 341/173, 176; 340/825.69, 825.72, 825.73, 825.31, 825.32; 455/93, 102

[56] References Cited

U.S. PATENT DOCUMENTS

| | | | |
|---|---|---|---|
| 4,103,238 | 7/1978 | Deming et al. | 325/141 |
| 4,360,801 | 11/1982 | Duhame | 340/521 |
| 5,379,453 | 1/1995 | Tigwell | 455/151.2 |
| 5,442,340 | 8/1995 | Dykema | 340/825.22 |
| 5,471,668 | 11/1995 | Soenen et al. | 455/352 |
| 5,515,052 | 5/1996 | Darbee | 341/176 |
| 5,563,600 | 10/1996 | Miyake | 341/173 |
| 5,564,101 | 10/1996 | Eisfeld et al. | 455/352 |
| 5,568,122 | 10/1996 | Xydis | 340/539 |
| 5,680,134 | 10/1997 | Tsui | 341/173 |

*Primary Examiner*—Jeffery A. Hofsass
*Assistant Examiner*—Ashok Mannava
*Attorney, Agent, or Firm*—Blakely, Sokoloff, Taylor & Zafman

[57] ABSTRACT

The present invention provides a transmitter-receiver system which may selectively operate at one of a plurality of transmission frequencies and may selectively encode/decode the transmitted data in one of a plurality of data transmission formats. The present invention also provides a transmitter-receiver system in which a signal is transmitted using at least two different formats, so that manual selection of a specific transmission format is not required. Each transmitter and receiver includes a microcontroller which has been programmed to implement multiple encoding/decoding schemes and multiple data transmission formats in the unit. The microcontrollers may be programmed to implement any desired encoding/decoding scheme including the capability of emulating the encoding/decoding schemes and data transmission formats of transmitter-receiver systems currently in common use. The encoding/decoding scheme, the data transmission format and the data transmission frequency of the units are easily selectable from preprogrammed alternatives via selected switch settings in the individual devices. The transmitter or receiver may then be used in conjunction with the corresponding transmitter and/or receiver having the selected operating parameters, including but not limited to ASIC-based systems.

10 Claims, 25 Drawing Sheets

| | |
|---|---|
| FIG. 7A | |
| FIG. 7B | |

| | |
|---|---|
| FIG. 9A | FIG. 9B |

FORMAT 1
2ms
2ms

FORMAT 2
1.5ms
0.5ms

FORMAT 3
0.9ms
1.8ms
1.8ms
2.7ms

FORMAT n
3.2ms
19.2ms
1.6ms

REMOTE TRANSMITTER-RECEIVER CONTROLLER FOR MULTIPLE SYSTEMS

The present application is a continuation-in-part of U.S. patent application Ser. No. 08/583,883, filed Jan. 11, 1996 now U.S. Pat. No. 5,680,134, which is a continuation of U.S. patent application Ser. No. 08/270,374, filed Jul. 5, 1994 now abandoned.

BACKGROUND OF THE INVENTION

1. Field of the Invention

This invention is directed in general to controller systems including transmitters and/or receivers which operate on a coded signal and, in particular, to a controller system in which the transmitter and receiver are capable of selectively operating with one of a plurality of coded signals at a plurality of frequencies. The transmitter of the present invention may also be configured to transmit the coded signal in at least two different formats.

2. Prior Art

Transmitter-receiver controller systems (hereinafter transmitter-receiver systems) are widely used for remote control and/or actuation of devices or appliances such as garage door openers, gate openers, security systems, and the like. For example, most conventional garage door opener systems use a transmitter-receiver combination to selectively activate the drive source (i.e., motor) for or opening or closing the door. The receiver is usually mounted adjacent to the motor and receives a coded signal (typically RF) from the transmitter. The transmitter is carried in the vehicle by user and selectively activated by a user to send the coded signal to open or close the garage door.

Different manufacturers of such transmitter-receiver systems normally utilize different code schemes for the coded signal and may also operate their products at different transmission frequencies within the allocated frequency range for this type of system. The code scheme typically includes two aspects: 1) a device code (equivalent to a device address) for the transmitter and receiver, and 2) a transmission format, i.e., the characteristics of the transmitted signal including timing parameters and modulation characteristics related to encoded data. The code scheme used by one manufacturer is usually incompatible with the code schemes of systems produced by other manufacturers. Currently available transmitter-receiver systems typically employ custom encoders and decoders to implement the code scheme. These encoders and decoders are fabricated with custom integrated circuits such as application-specific integrated circuits (ASICs). They are, to a large degree, fixed hardware devices and allow very limited flexibility in the encoding/decoding operation or in the modification of the encoding/decoding operation.

Consequently, if a user has two or more systems from different manufacturers, multiple transmitters may be necessary to operate all of the systems. For example, if a user has multiple garages (e.g., a vacation home, an office or the like), multiple transmitters may be required to operate different systems at each location. Moreover, businesses that sell or maintain transmitter-receiver systems from more than one manufacturer must maintain an inventory of each type of device when the transmitters-receivers have distinct code transmission format or transmission frequency requirements.

To provide greater flexibility and avoid the requirement for multiple inventories, there is a need for a transmitter unit and a receiver unit which can selectively emulate the transmitters and receivers of other transmitter-receiver systems to enable the transmitter unit and/or receiver unit to operate in such other systems. There is also a need for a transmitter unit that can emulate the transmitters of at least two different transmitter-receiver systems without manual selection of the transmission formats. There is a further need for a receiver unit that can be actuated by at least two different transmitters without having to preset the receiver for reception of specific transmission formats.

SUMMARY OF THE INVENTION

The present invention provides a transmitter-receiver system which may selectively operate at one of a plurality of transmission frequencies and may selectively encode/decode the transmitted data in one of a plurality of data transmission formats. The present invention also provides a transmitter-receiver system in which a signal is transmitted using at least two different formats, so that manual selection of a specific transmission format is not required. Each transmitter and receiver includes a microcontroller which has been programmed to implement multiple encoding/decoding schemes and multiple data transmission formats in the unit. The microcontrollers may be programmed to implement any desired encoding/decoding scheme including the capability of emulating the encoding/decoding schemes and data transmission formats of transmitter-receiver systems currently in common use. The encoding/decoding scheme, the data transmission format and the data transmission frequency of the units are easily selectable from preprogrammed alternatives via selected switch settings in the individual devices. The transmitter or receiver may then be used in conjunction with the corresponding transmitter and/or receiver having the selected operating parameters, including but not limited to ASIC-based systems.

DESCRIPTION OF PREFERRED EMBODIMENTS

Figure 1:
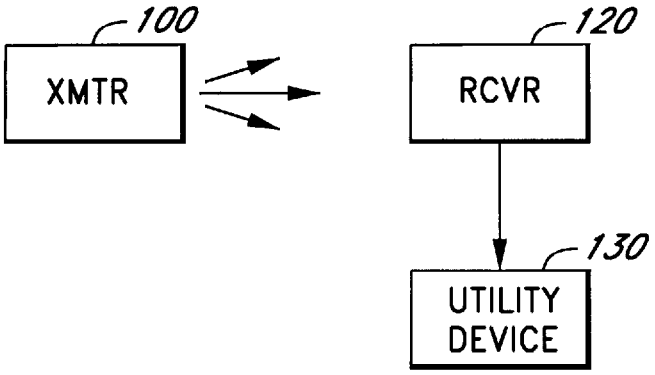
FIG. 1 is a block diagram illustrating a typical transmitter-receiver system.

Referring now to the drawings, and in particular to FIG. 1, there is shown a block diagram of a typical transmitter-receiver system. In FIG. 1, transmitter 100 is any suitable transmitter capable of generating an electromagnetic wave represented by the arrows 101. The frequency of the signal 101 generated by transmitter 100 and the encoding and data transmission scheme is a function of the particular transmitter design. A receiver 120 is adapted to receive the signals 101 from the transmitter 100, interpret the signals and produce an output signal to drive a utility device 130.

In a representative utilization, the transmitter 100 is a remote control device which can be used with the receiver 120 as part of a garage door opening system. In this representative utilization, utility device 130 may be the garage door mechanism, including the motor, drive mechanism, lighting apparatus and/or the like. The utility device 130 opens or closes a garage door (for example) when activated by receiver 120 upon receipt of the appropriate signal from the transmitter 100. While a garage door opening mechanism is illustrative, many other types of utility devices may be controlled by such remote transmitter-receiver systems.

The transmitter 100 when activated generates a signal 101 having a prescribed signal frequency and a unique data transmission format; that is, the timing parameters and modulation characteristics related to encoded data are unique to the design of the particular transmitter. The receiver 120 is adapted to receive and decode the signals generated by the transmitter 100 to produce an output signal which is supplied to the utility device 130. In the conventional transmitter-receiver system, the transmitter 100 and the receiver 120 operate at a single transmission frequency and are implemented with ASIC devices. Consequently the transmitter 100 and receiver 120 can only transmit and receive a single data transmission format and at the single transmission frequency.

The transmitter 100 and receiver 120 typically have a device code (or device address) which is selectable by setting a plurality of corresponding DIP switches in each unit. Identical device codes are required for communication between a transmitter 100 and a receiver 120. Setting the DIP switches to identical settings (on or off) in each unit provides identical device codes. Communication between the transmitter 100 and receiver 120 is accomplished according to a specific data transmission format which typically is unique to devices provided by the manufacturer of the specific transmitter-receiver system. This data transmission format is implemented with ASIC-type encoders and decoders which can transmit and receive only the single data format implemented in the ASIC circuitry.

Figure 2:
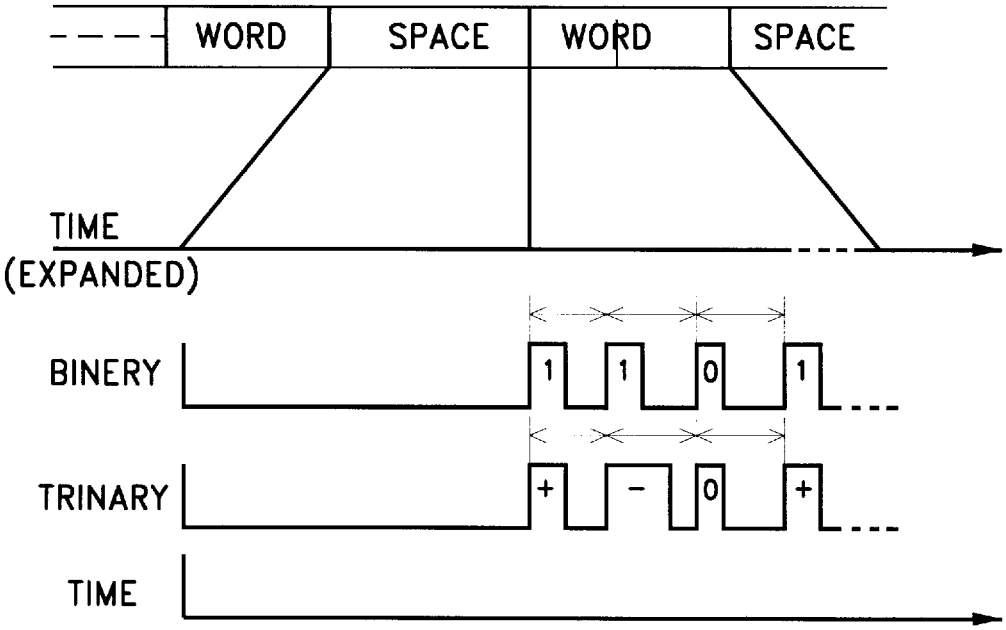
FIGS. 2–4 are graphic representations illustrating data transmission formats which are typically used in conventional transmitter-receiver systems and which may be implemented in the transmitter-receiver system of the instant invention.
Figure 3:
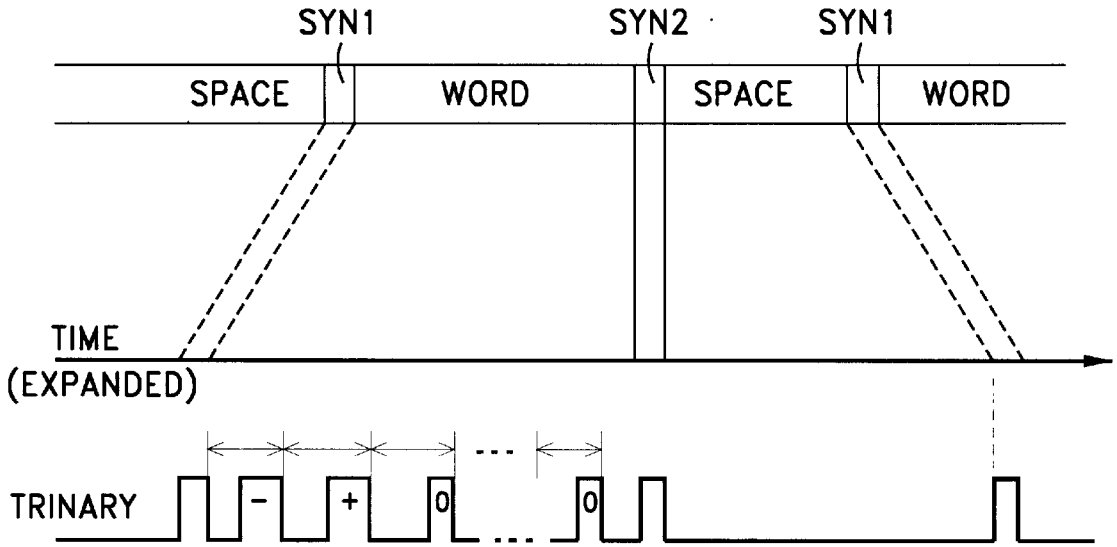
Figure 4:
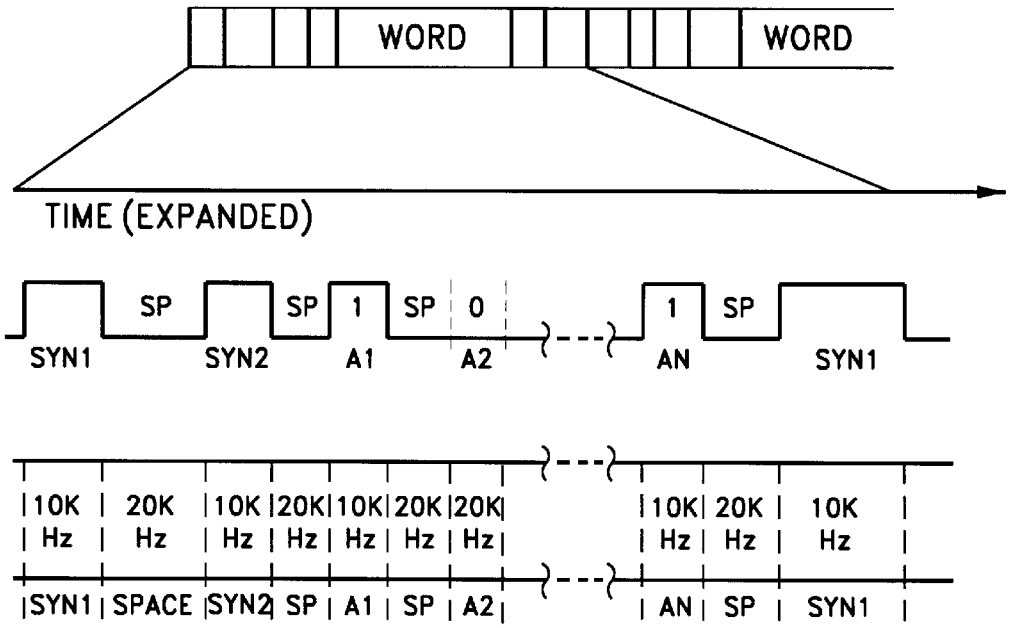

FIGS. 2–4 illustrate three types of data transmission formats utilized in existing transmitter-receiver systems. In the exemplary format shown in FIG. 2, data words are transmitted separated by spaces. The length (i.e., time slot) of the separating space is typically similar to the length of a data word, although most details of the format are at the option of the designer. The data word is typically divided into equal time slots for each bit of data. In one existing binary implementation (illustrated in FIG. 2), a pulse equal to one half of a time slot represents a logical one and a pulse equal to a quarter time slot equals a logical zero. In another existing implementation (not shown), a logical one is three quarters of a time slot and a logical zero is one quarter of a time slot.

In one implementation of this type of format an eight-bit binary data word is 32 ms in length (4 ms per bit with pulses of 2.0 ms and 0.5 ms representing logical 1 and logical zero, respectively) and the data words are separated by spaces of 32 milliseconds. This format may also be thought of as a data word of 2 ms per bit with each bit separated by a space of 2 ms. In another implementation, a ten-bit data word is 20 ms in length (2 ms per bit with pulses of 1.5 ms and 0.5 ms representing logical 1 and logical zero, respectively) and data words are separated by spaces of 12 milliseconds.

FIG. 2 also illustrates a typical trinary implementation of this type of format where each bit may be a plus, a minus, or a zero. In this scheme, a plus state may be indicated by a pulse having a pulse width equal to one half of a bit time slot, a minus state by a pulse having a width of three quarters of the time slot and a zero state by a pulse width of one quarter of the time slot. Of course many variations are possible.

In the encoding schemes illustrated by FIG. 2, the transmitted waveform is a signal at the transmission frequency which is turned on and off in accordance with the pulse width of the encoded data bits. Thus, the transmitted waveform is a series of data words separated by spaces and comprising of a series of pulses at the transmission frequency having the appropriate pulse widths to indicate a logical one or a logical zero in the case of a binary system, or a plus, a minus, or a zero in the case of a trinary system.

Referring to FIG. 3, a second type of data transmission format there illustrated includes a first synchronization pulse, followed by a short space, followed by a data word, followed by a second synchronization pulse, followed by a long space, followed by another first synchronization pulse to start a second data sequence. The data word is typically divided into equal time slots for each bit of data. As in the case of the previous exemplary trinary system, typically shown and described relative to FIG. 1, a minus state may be indicated by a pulse having a width of three quarters of the pulse time slot, a plus state may be indicated by a pulse having a width of one half the time slot, and a zero state may be indicated by a pulse having a width of one quarter of the bit time slot. The transmitted waveform is therefore of a series of pulses at the transmission frequency separated by appropriate spaces to define the synchronization pulses and the data bits.

FIG. 4 illustrates a binary encoding system employing synchronization pulses as described in connection with FIG. 3, but also incorporating a frequency shift keying (FSK) format. In the binary FSR system illustrated, signals such as synchronization pulses and logical one data bits are represented by a signal at a first frequency (such as ten KHz). Spaces and logical zeros are represented by a second frequency (such as twenty KHz). The transmitted waveform is therefore a signal at the transmission frequency which is turned on and off at the first frequency or the second frequency, as appropriate, in accordance with the pulse width of the encoded data bits, the synchronization pulses and the spaces.

The described data transmission formats are employed in existing transmitter-receiver systems. In order to selectively transmit and/or receive in one of the above formats or in different formats, the transmitter and receiver of the instant invention each employ a programmable microcontroller to selectively provide operation in a plurality of data transmission formats.

Figure 5:
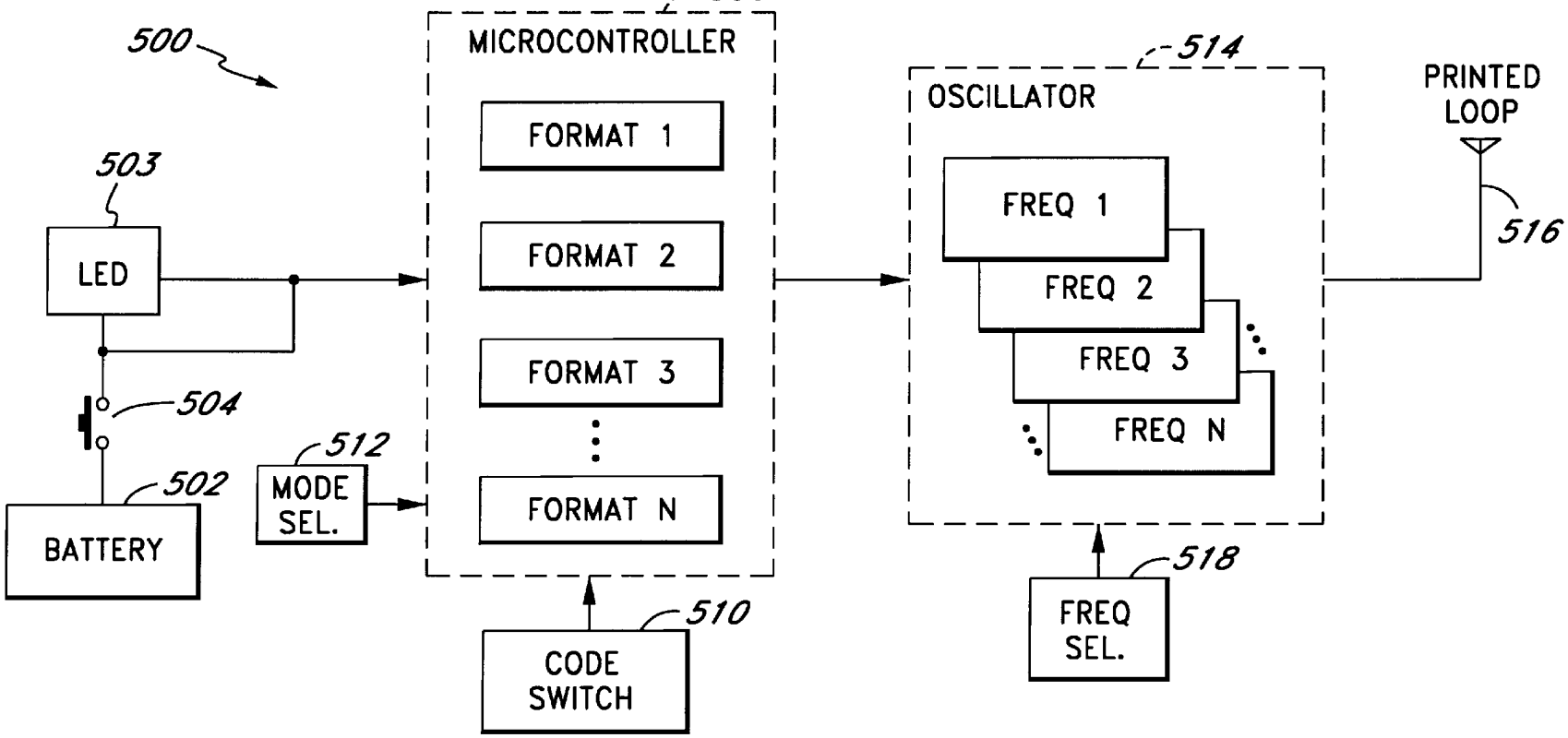
FIG. 5 is a block diagram of a transmitter according to the instant invention.

Referring now to FIG. 5, there is shown a high level block diagram of transmitter 500 according to the present invention which may selectively emulate the operation of the transmitter of a plurality of other transmitter-receiver systems. Power is supplied to the transmitter circuitry by a suitable power source such as lithium battery 502. The power is applied by actuating a momentary contact switch 504 which couples power to a microcontroller 506 via a battery status indicator such as a light emitting diode (LED) 508. The microcontroller 506 is a programmable unit which can be programmed to selectively effect the same data transmission format as other transmitter-receiver systems. Many programmable integrated circuits, such as are available from NEC, Motorola or Texas Instruments, Inc., are suitable for use as microcontroller 506 in the present invention as will be recognized by persons in the art.

The microcontroller 506 operates to selectively generate an output signal having one of a plurality of data transmission formats or modes of operation. A code switch 510 selects a device code for the transmitter 500 and provides appropriate inputs to the microcontroller. Similarly, a mode select control 512 provides control signals to the microcontroller 506 to control the program operation of the microcontroller 506 to provide the selected data transmission format. The output of the microcontroller is typically a serial pulse train containing the data word and any required synchronization or timing pulses. The microcontroller produces an encoded signal similar to the signal which would be produced by the individual ASIC encoders or other kinds of integrated circuits. Since the output wave shape of the microcontroller 506 is determined by the programming of the microcontroller, the output wave shape may be easily modified or varied as required to provide virtually any format including the formats of FIGS. 2–4 and variations thereof. The operation of the microcontroller 506 will be described more fully in connection with FIGS. 10–12 hereinafter.

The serial pulse train produced at the output of microcontroller 50 is coupled to an oscillator 514 for transmission of the encoded signal via a printed loop antenna 516. The oscillator 514 is turned on and off in accordance with the serial pulse train to transmit a series of pulses as defined by the microcontroller output wave shape. One of a plurality of transmission frequencies may be selected by frequency select control 518 which selects the frequency of the oscillator 514.

Once the code switch 510 the mode select control 512 and the frequency select control 518 have been set, the transmitter 500 will generate an output signal having a selected device code, a selected data transmission format and a selected data transmission frequency. Thus the microcontroller transmitter 500 may emulate the transmitter of other transmitter-receiver systems or may operate with any format which may be generated by the microcontroller.

Figure 6:
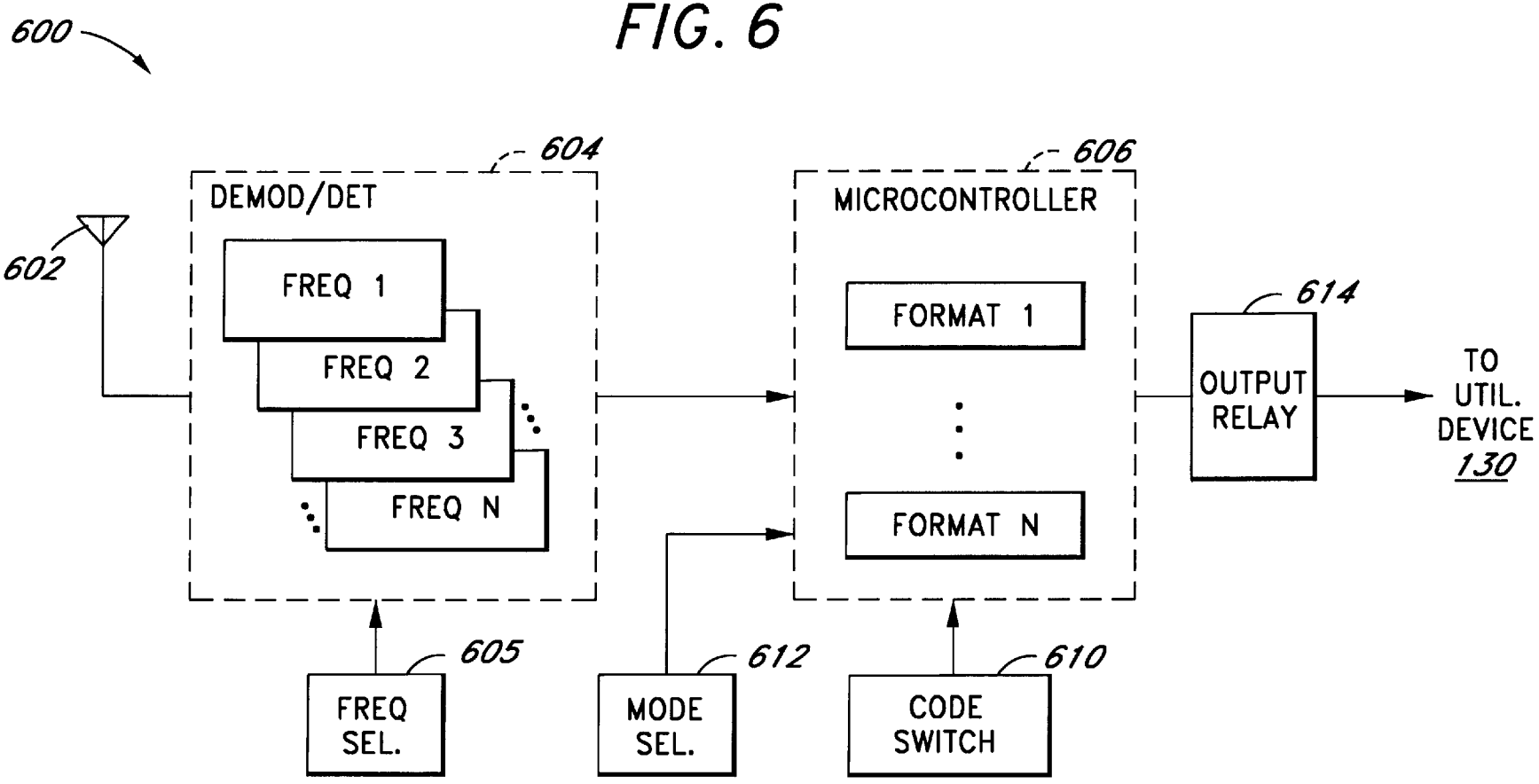
FIG. 6 is a block diagram of a receiver according to the instant invention.

FIG. 6 is a high level block diagram of a receiver 600 according to the present invention which may selectively emulate the operation of the receiver of other transmitter-receiver systems. The signal is received by printed loop antenna 602 and coupled to a demodulator/detector 604 for removing the transmission frequency and detecting the transmitted data. The frequency of the oscillator demodulator/detector 604 is selected by frequency select control 605. The detected data, a serial pulse train, is coupled to microcontroller 606 which corresponds to the microcontroller in the transmitter 500.

The microcontroller 606 is programmed to decode an input signal having one of a plurality of data transmission formats. A device code select switch 610 and a mode select control 612 provide inputs to control the operation of the microcontroller program to decode the pulse train according to the appropriate data transmission format and device code. The microcontroller 606 decodes the received data and generates an output signal which is coupled via relay 614 to actuate the utility device 130.

Thus, once the code select switch 610, the mode select control 612 and the frequency select control 605 have been set, the receiver 600 may emulate the receiver of an existing transmitter-receiver system or operate with any format that may be decoded by the microcontroller.

Figures 7, 7A:
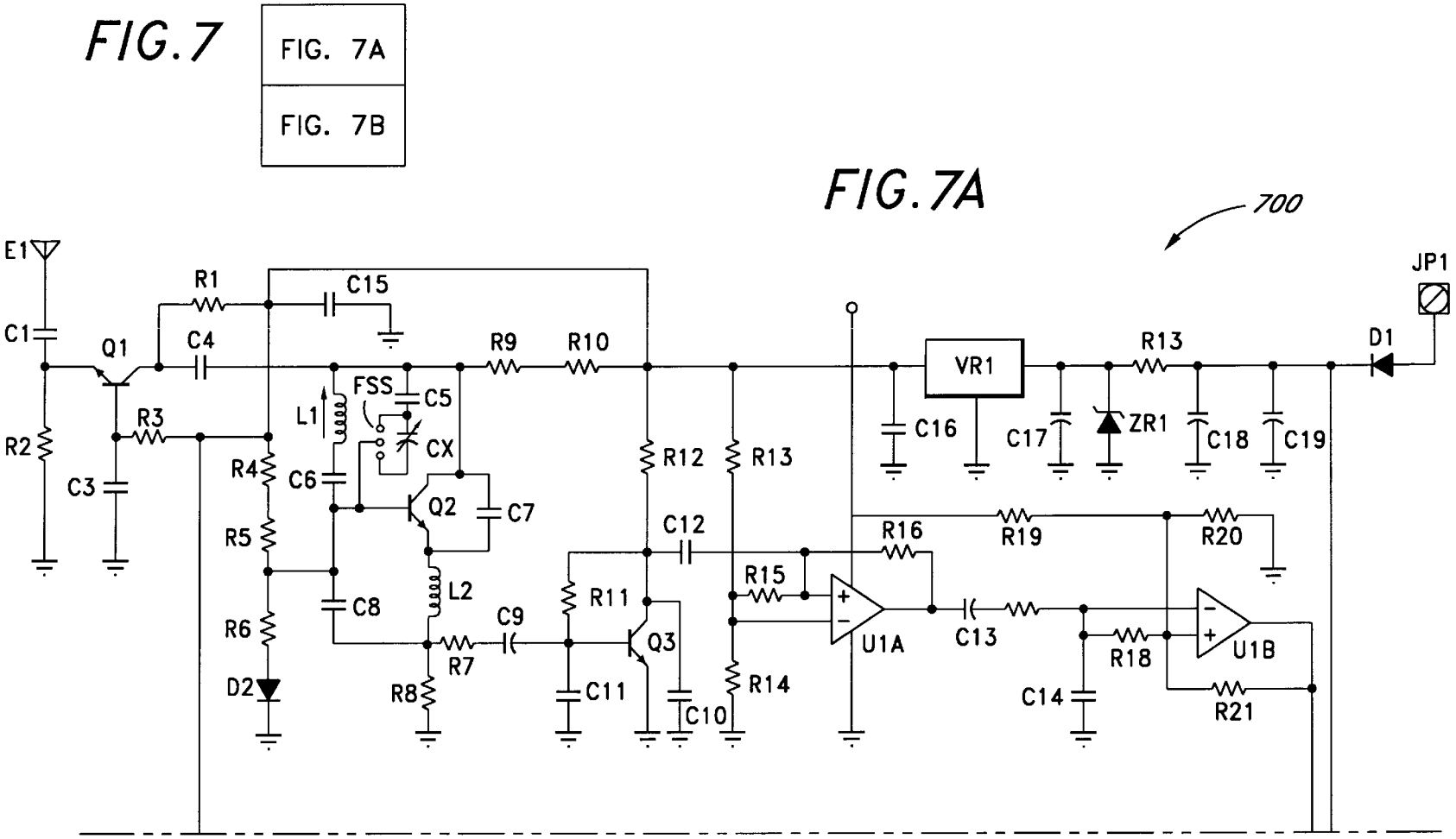
FIG. 7 is a schematic diagram of a preferred embodiment of a receiver according to the present invention.
Figure 7B:
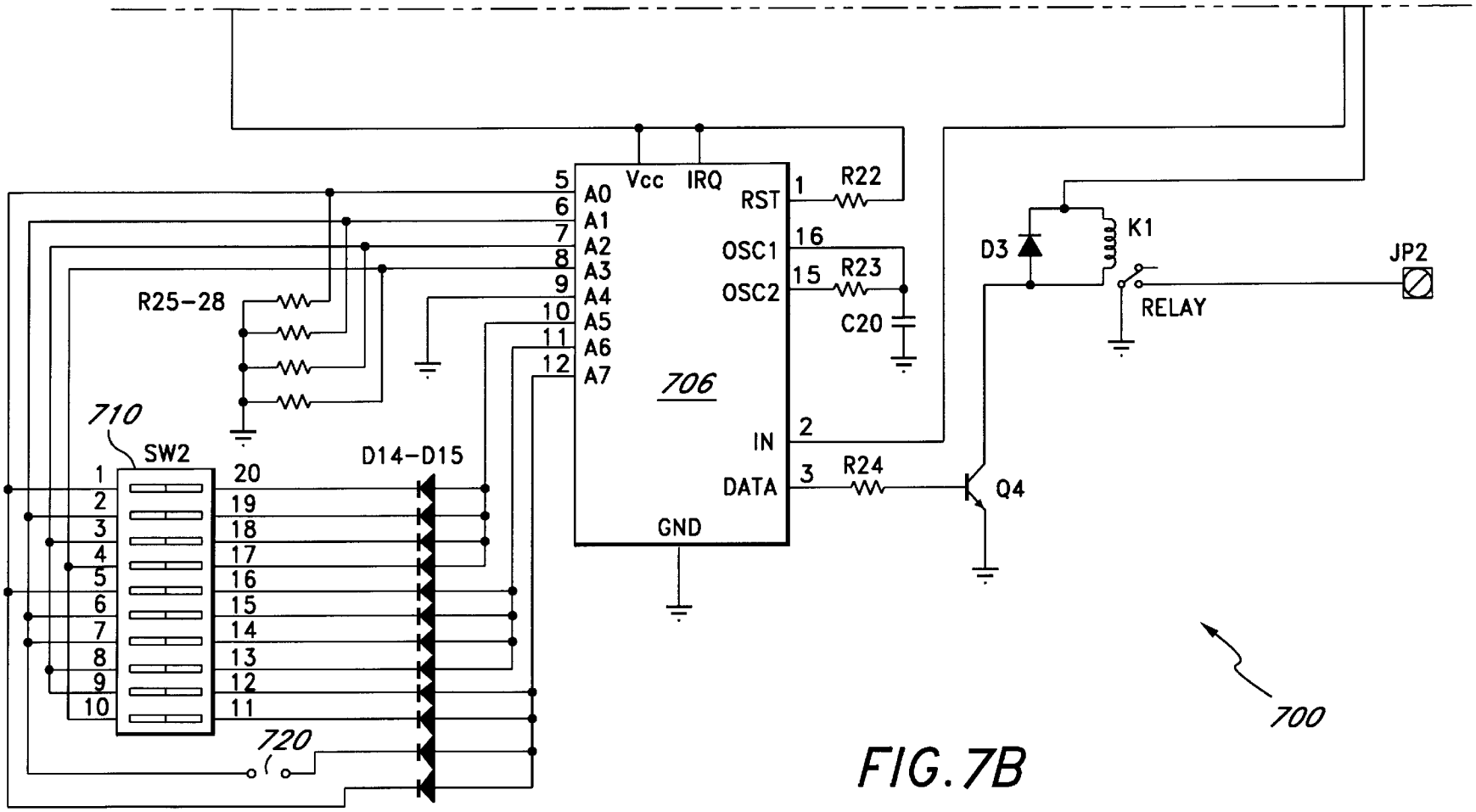
Figure 8:
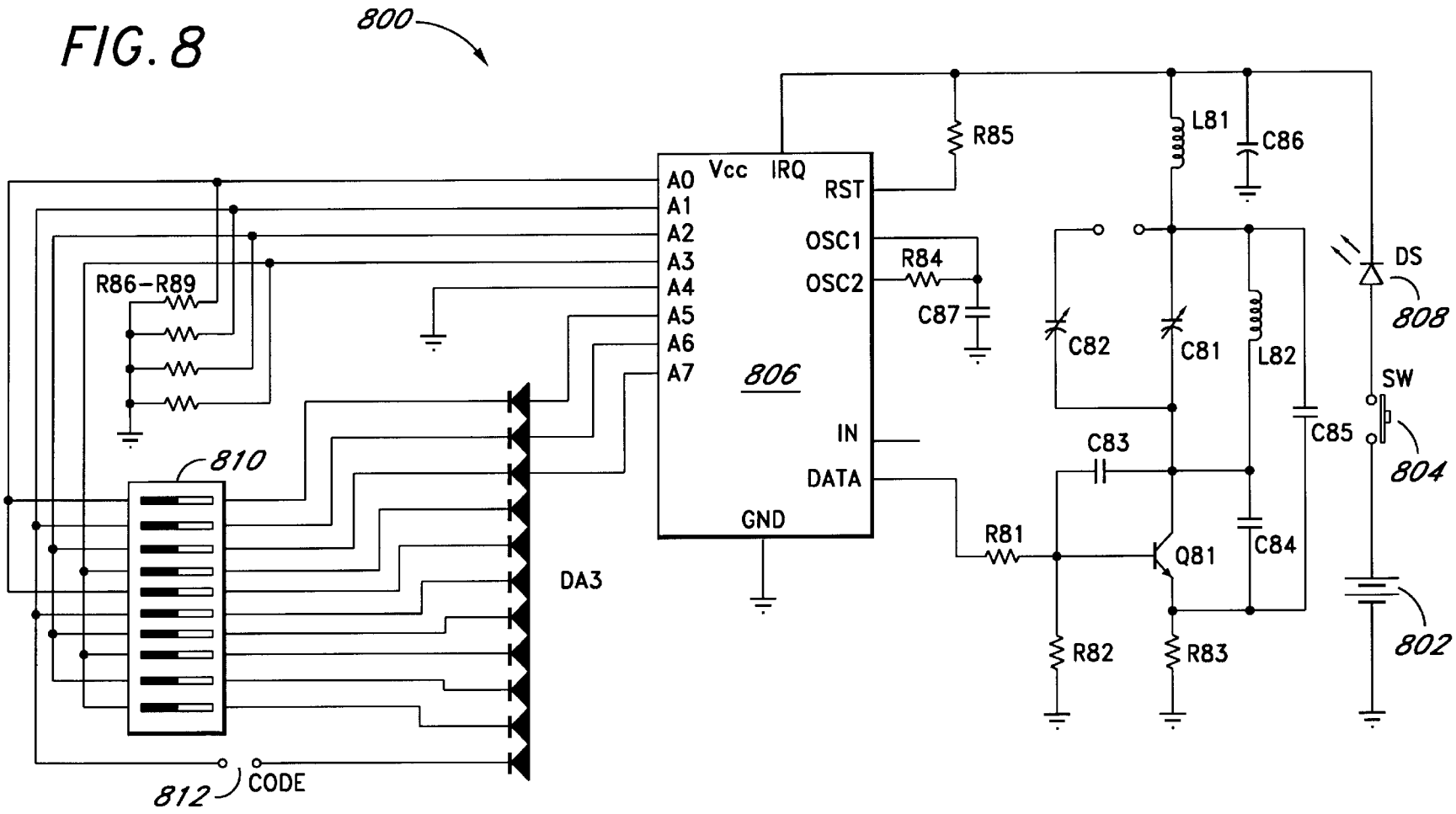
FIG. 8 is a schematic diagram of a preferred embodiment of a transmitter according to the instant invention.
Figures 9, 9A:
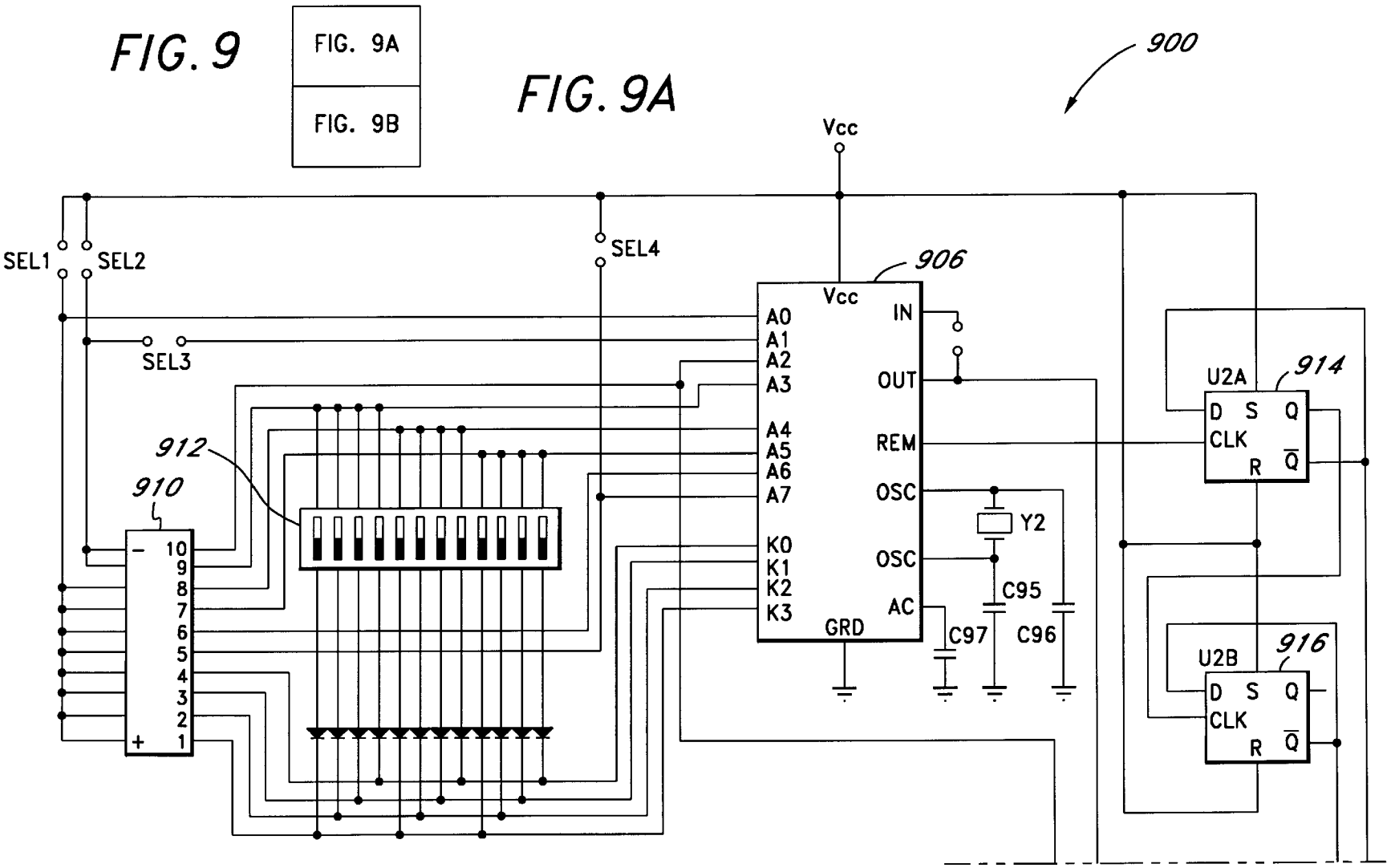
FIG. 9 is a schematic diagram of an alternate preferred embodiment of a transmitter according to the present invention.
Figure 9B:
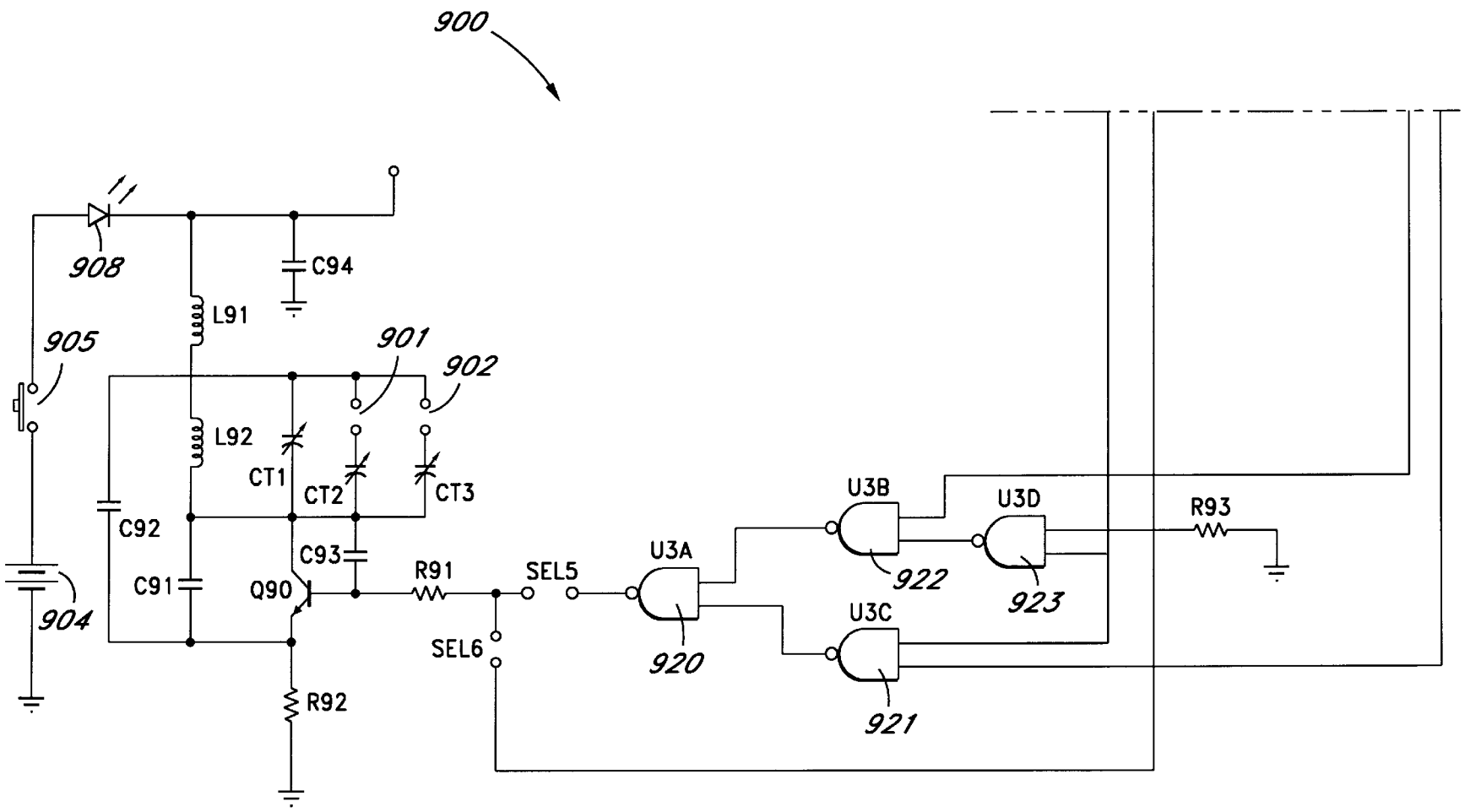

FIGS. 7, 8, and 9 illustrate separate embodiments of the invention. FIG. 7 is a schematic diagram of an operative embodiment of a receiver 700 having two data transmission formats and operating at two transmission frequencies. The receiver 700 includes a power supply which includes voltage regulator VR1. The regulator VR1 is connected to a suitable power source at the junction point JP1. The receiver 700 includes a suitable antenna E1 which is connected to one stage of RF amplification (including transistor Q1 in conventional configuration). The RF network is connected to the local oscillator (LO) including transistor Q2, inductor L1, capacitors C6 and C5 and variable capacitor Cx. The frequency of the local oscillator is a function of the capacitance connected in series with and/or in parallel with the inductor L1.

A frequency select switch FSS provides for the selection of one of two local oscillator frequencies by changing the capacitance in the local oscillator circuit. A jumper may be connected across the terminals of switch FSS to selectively connect the variable capacitor Cx in series with capacitor C5 to allow the selection of the local oscillator frequency to conform to the frequency of the received signal. It will be recognized that the use of a variable capacitor allows frequency of the local oscillator to be fine tuned through a range of frequencies. It will also be recognized that multiple frequencies are achievable by providing for further variation of the capacitance of the local oscillator circuit. In the instant embodiment for any set value of capacitor Cx, the positioning of the jumper across the terminals of switch FSS, allows the selection of one of two LO frequencies. The local oscillator is connected to a demodulating circuit including transistor Q3 for amplification and for demodulation of the output signal from the local oscillator.

The demodulated signal is supplied through appropriate detector circuits U1A and U1B to the data input of a microcontroller 706. The data input signal to the microcontroller 706 is a train of pulses having a specific format as generated by the transmitter 600. The microcontroller 706 is also coupled to DIP switch 710 (a 10 bit switch is shown) for reading a device code into the microcontroller. The microcontroller interrogates the positions of the DIP switches by multiplexing output signals from ports A4–A7 and receiving corresponding input signals over ports AO–A3. Of course, additional switches 710 may be utilized for larger or more complicated codes.

The microcontroller 706 is programmed to decode the received pulse train which contains the device code of the transmitter 600, compare the decoded device code (address) of the transmitter with the device code (address) of the receiver 700 as set by the individual positions of the DIP switch 710, and provide a data output signal at the DATA terminal when the device code of the transmitter and receiver are identical. When the device codes are identical, a data output signal from the microcontroller 706 is coupled to activate transistor Q4.

The microcontroller may be programmed to decode pulse trains having multiple data transmission formats. Control inputs which are provided to the microcontroller 706 select processing appropriate for the format of the incoming signal. In the receiver of FIG. 7, the microcontroller 706 is programmed to decode input data received in two formats. The control input is provided by the presence or absence of a jumper across the "code" terminals 720 which couples output port A7 to input port A1 for interrogation by the microcontroller. The resulting control input status selects the appropriate processes in the microcontroller 706 to decode the received signal.

When transistor Q4 is turned-on, a circuit is completed through coil of the relay K1. Activation of the relay K1 moves the armature of the relay and connects output terminal JP2 to ground, thereby applying a voltage between the input terminal JP1 and terminal JP2. This voltage is thus available to actuate the operation of a utility device such as a garage door opening system.

FIG. 8 is a schematic diagram of a transmitter 800 which corresponds to the receiver 700 of FIG. 7 in that it has two data transmission formats and operates at two different transmission frequencies. Closure of switch 804 applies power from the battery 802 to the transmitter circuitry. An LED 808 or similar device is coupled in the circuit to indicate that the switch 804 has been closed and that the battery is operative. DIP switch 810 functions as the device code select switch for reading the device code into a microcontroller 806. As in the receiver 700, the microcontroller 806 interrogates the positions of the DIP switches by multiplexing output signals from ports A4–A7 and receiving corresponding input signals over ports A0–A3. Similarly, control inputs are provided to the microcontroller 706 to identify the format of the signal to be generated.

Microcontroller 806 is programmed to encode output data in two formats. The control input selecting the appropriate data transmission format is provided by the presence or absence of a jumper across the "code" terminals 812 which couples output port A7 to input port A1 for interrogation by the microcontroller. The resulting control input status selects the appropriate encoding processes in the microcontroller for generating an output signal of the selected format.

The output signal, in the form of a pulse train (i.e., serial data) having the selected format and containing the appropriate device code, is then coupled from the DATA terminal of microcontroller 806 to the base of transistor Q81 to turn the transmitter output oscillator circuit on and off. The pulse train selectively activates the output oscillator to provide a transmitted signal through antenna coils L81 and L82. The transmitted output of the oscillator is a signal with required data transmission format at the frequency of the oscillator. The output frequency generated across the inductor (or transmitter coil) is a function of the capacitance connected in series with and/or in parallel with the respective coils. As in the case of the receiver of FIG. 7, the frequency can be changed by alteration of the frequency jumper 814.

Referring now to FIG. 9, there is shown an alternative transmitter configuration 900 having five selectable data transmission formats and three selectable transmission frequencies. The transmission frequency is selected by means of jumpers selectively connected at terminals 901 and 902 which select the capacitance in the output oscillator circuit including transistor Q90, inductors L91 and L92 and the data transmission format are selected based on the settings of DIP switch 910 (a twelve bit switch) and DIP switch 912 (a 10 bit switch) and the selective connection of jumpers across terminals SEL 1, SEL 2, SEL 3, SEL 4, SEL 5, and SEL 6.

In the case of a data format such as shown in FIGS. 2 and 3, the data out port of the microcontroller 906 is coupled by terminals SEL 6 to the base of transistor Q90 to modulate the operation of the output oscillator according to the desired wave form. When an FSK type output signal such as shown in FIG. 4 is required, the REM output of the microcontroller 906 may be used. The REM output (in this particular microcontroller) is a 40 KHz signal having an envelope identical to the serial pulse train present at the DATA terminal of the microcontroller 906. Flip-flops 914 and 916 serve as divide by 2 and divide by 4 circuits, respectively, to convert the pulses from the 40 KHz REM output to the 20 KHz signals and the 10 KHz signals required for the FSK format. The $\overline{Q}$ outputs from the flip-flops are coupled to Nand gates 922 and 923 respectively, to selectively turn the output oscillator on and off at the 20 KHz or 10 KHz rate as required by the data transmission format.

Figure 10:
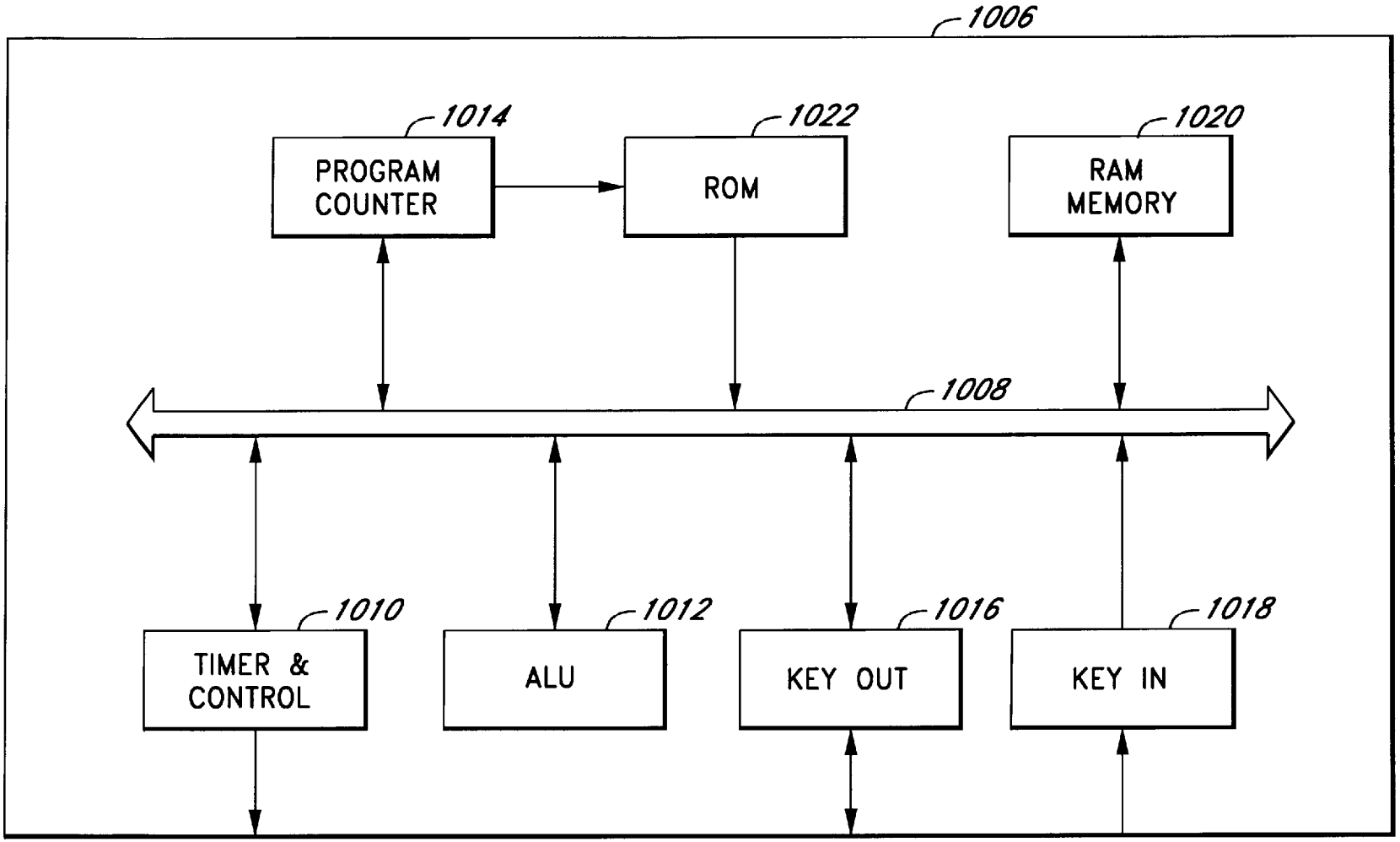
FIG. 10 is a simplified block diagram of a typical microcontroller.
Figure 11:
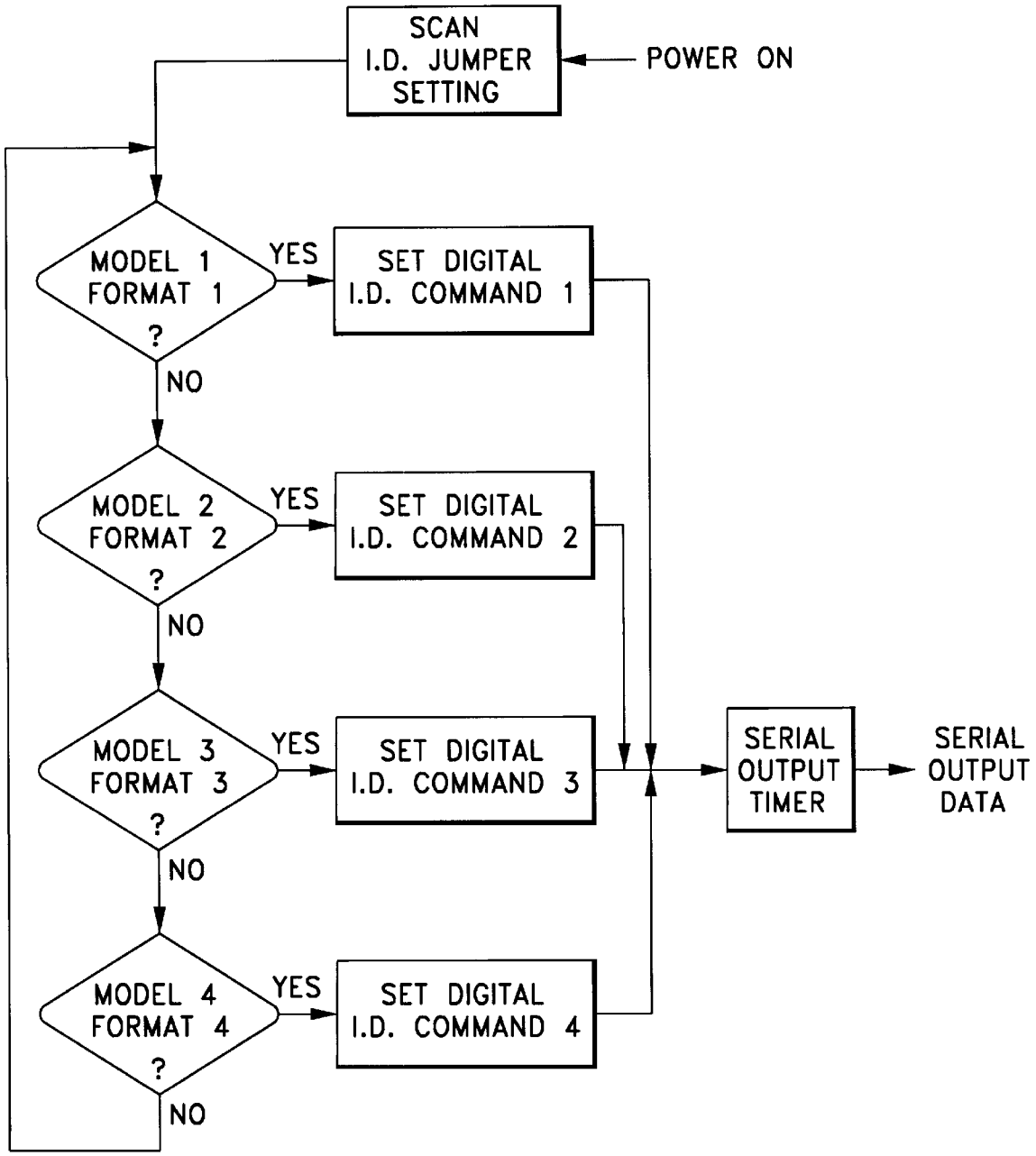
FIGS. 11 and 12 are flow diagrams illustrating the processes carried out in the transmitter microcontroller and the receiver microcontroller, respectively.
Figure 12:
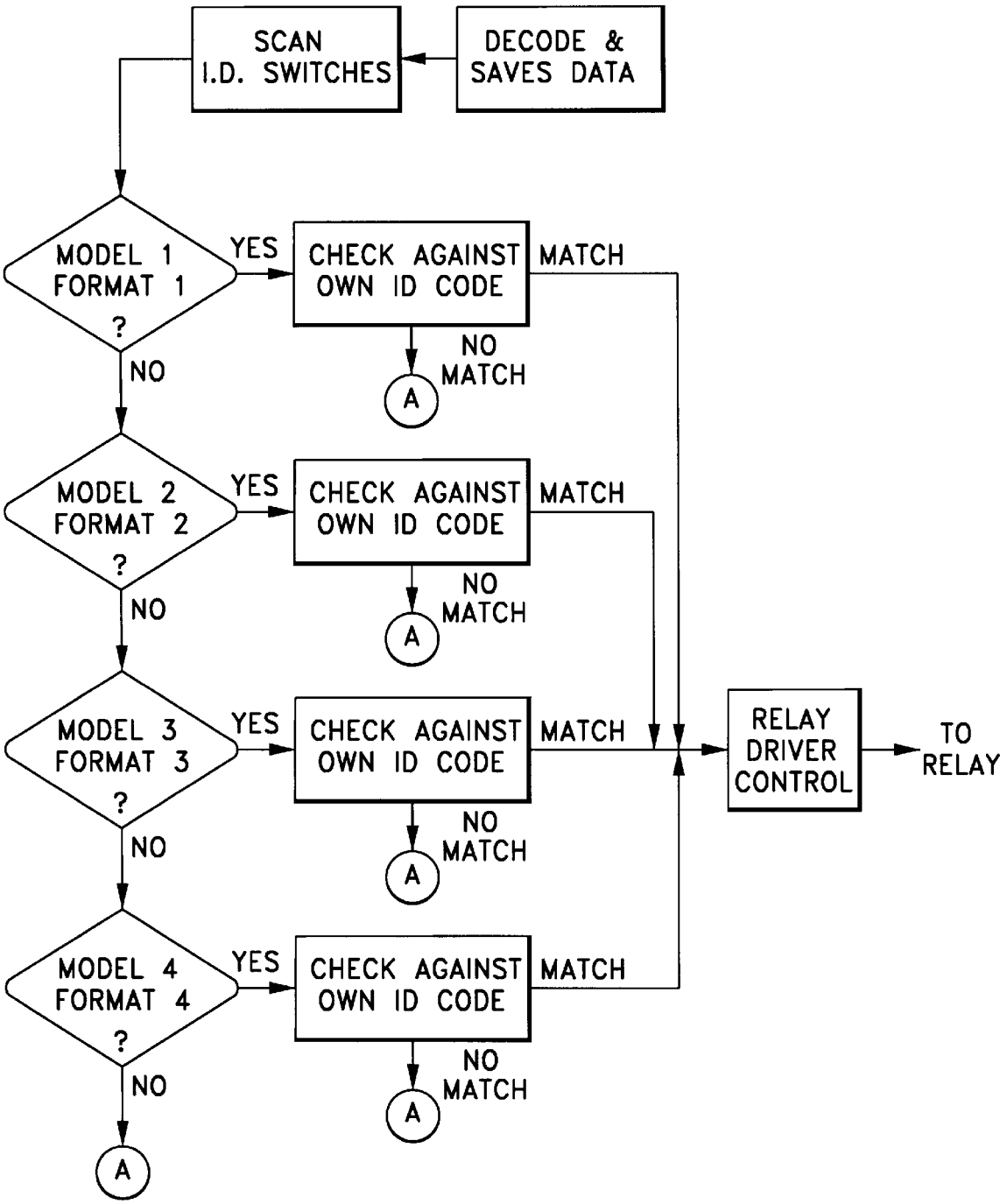

Referring now to FIGS. 10–12, FIG. 10 is shown a simplified block diagram of a typical conventional microcontroller 1006 such as is contemplated for use in the transmitter and receiver of the present invention. The microcontroller 1006 includes data bus 1008 coupled to enable communication between a timing and control unit 1010, an arithmetic logic unit (ALU) 1012, a program counter 1014, a key-out unit 1016, a key-in unit 1018, random access memory (RAM) 1020, and a read only memory (ROM) 1022. The program counter 1014 is coupled directly to the ROM 1022 and the timing and control unit 1010. The key-out and key-in units 1016 and 1018 may be coupled to receive external signals. Turning now to the flow diagram of FIG. 11, the transmitter microcontroller operates as follows in the following manner. Upon the application of power, the program counter 1014 executes instructions in ROM 1022 to scan the logic blocks of the key-out unit 1016 and the key-in unit 1018 to determine external inputs to the microcontroller (i.e., read the chosen device code and the chosen data transmission format or mode). This data is stored in RAM 1020. The DIP switch settings are used to select the chosen device code and jumper settings are used to select the chosen data transmission format.

Next the program counter 1014 fetches the next group of sequential instructions in ROM 1022 to determine the format of the inputted data. This is done by comparing the fetched data in the ROM instruction with the data stored in the RAM 1020. Both of these data are transferred to the ALU 1012 for data comparison. Once the selected format is determined, a new digital command is written back to a location in RAM for outputting. The program counter 1012 then fetches the next group of ROM instructions which transfer the command to the timing and control unit for actual outputting of the serial pulse train.

Referring to FIG. 12, the microcontroller receiver operates in a similar manner to the microcontroller transmitter to decode the received signal. The program counter fetches instructions in ROM to instruct key-in and key-out blocks to scan DIP switch settings, jumper settings, and serial data input. This information is stored in designated locations in RAM. Upon detecting serial data valid, this data is saved in RAM for further processing to determine its device code and format information. The next instruction group transfers the serial data in the RAM to the ALU for actual comparison.

If the received device code matches the receiver's device code (i.e., DIP switch setting) and if the received data matches the receiver format (jumper setting), the ALU sends a unique data bit to the RAM to indicate a match. The next sequential instruction from the ROM transfers this unique data bit to the timing and control block for outputting to drive a relay control (such as relay K1 of FIG. 10).

Another aspect of the present invention involves a transmitter-receiver system in which a single transmitter may be used to actuate a plurality of different receivers, without manual selection of the code formats and/or the transmission frequencies of the transmitter. A further aspect of the present invention involves a transmitter-receiver system in which a single receiver may be triggered by a plurality of different transmitters without manual selection of the code format and/or the reception frequency of the receiver.

Figure 13A:
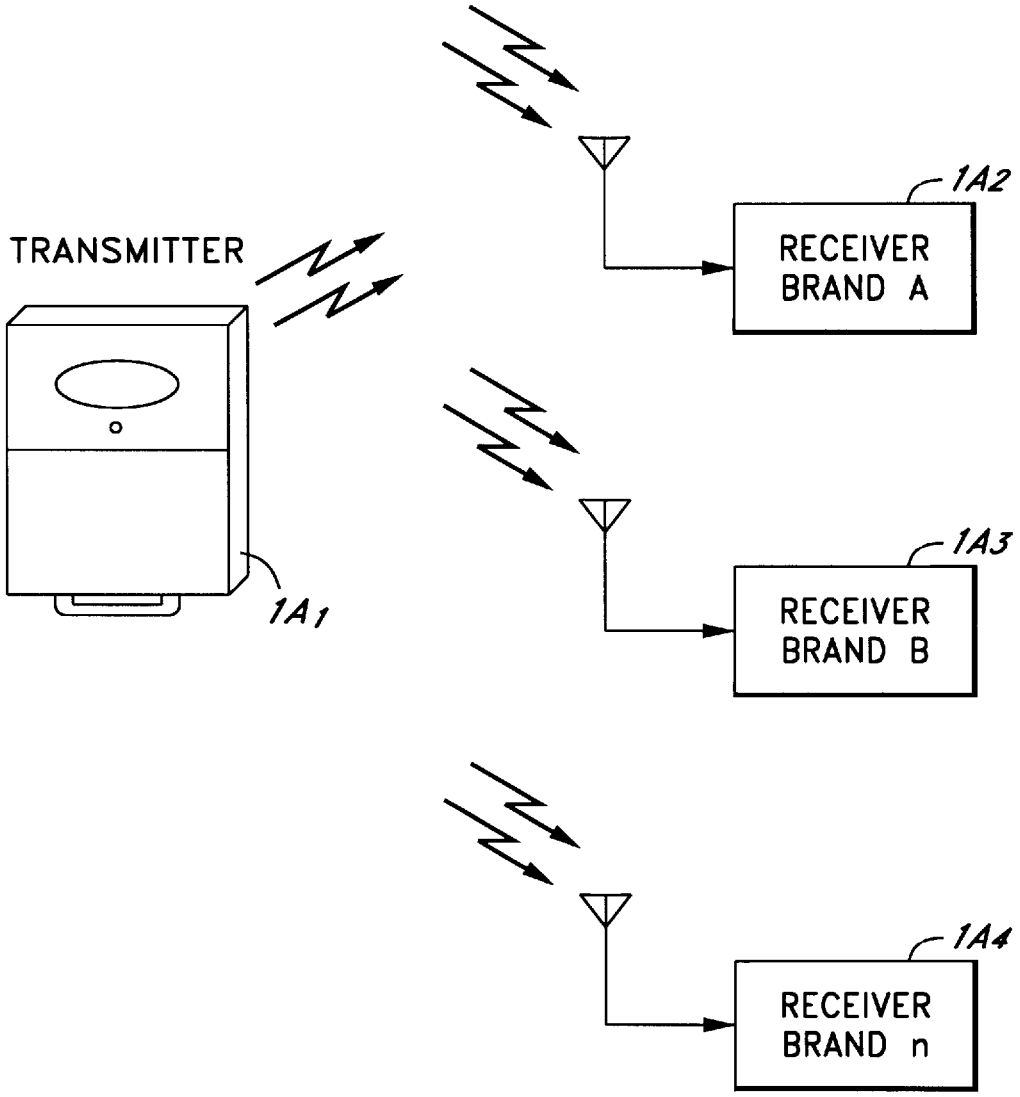
FIG. 13A is a block diagram illustrating one embodiment of a single transmitter-multi receiver system, in accordance with another aspect of the present invention, in which a single transmitter may actuate a plurality of different receivers.

FIG. 13A is a block diagram illustrating one embodiment of a single transmitter-multi receiver system, in accordance with another aspect of the present invention, in which a single transmitter may actuate a plurality of different receivers. As shown, the transmitter A1 is configured to actuate any or all of the three receivers A2, A3, A4, each of which has a different code format and reception frequency. As is understood by one of ordinary skill in the art, the transmitter A1 may be configured to activate fewer or more receiver.

Figure 13B:
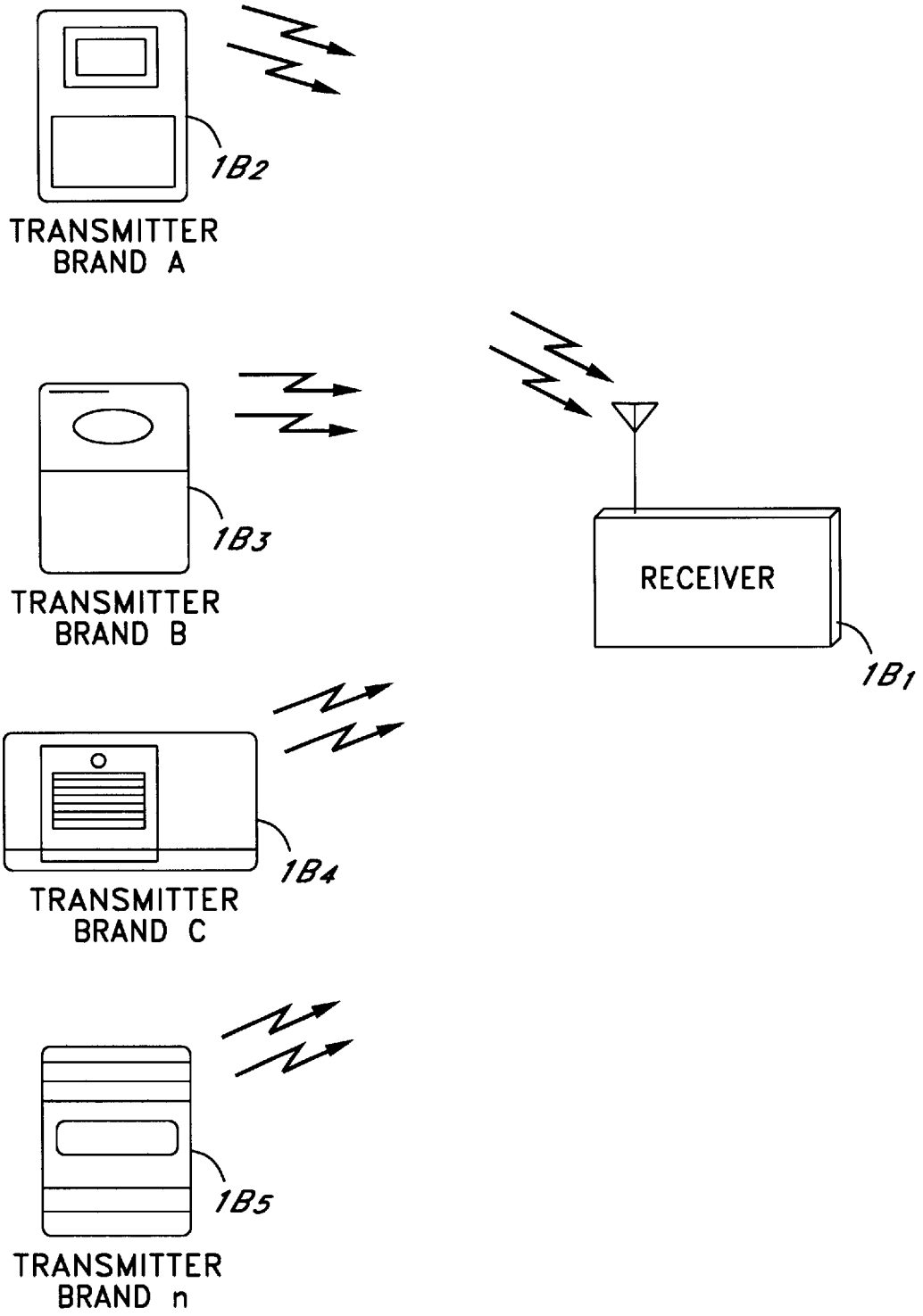
FIG. 13B is a block diagram illustrating one embodiment of a single receiver-multi transmitter system, in accordance with a further aspect of the present invention, in which a single receiver may be actuated by a plurality of different transmitters.

FIG. 13B is a block diagram illustrating one embodiment of a single receiver-multi transmitter system, in accordance with a further aspect of the present invention, in which a single receiver may be actuated by anyone of a plurality of different transmitters. As shown, the receiver B1 is configured to be actuated by any one or all of the transmitters B2, B3 and B4. As is understood by one of ordinary skill in the art, the receiver B1 may be configured to be actuated by fewer or a greater number of transmitters.

Figure 14A:
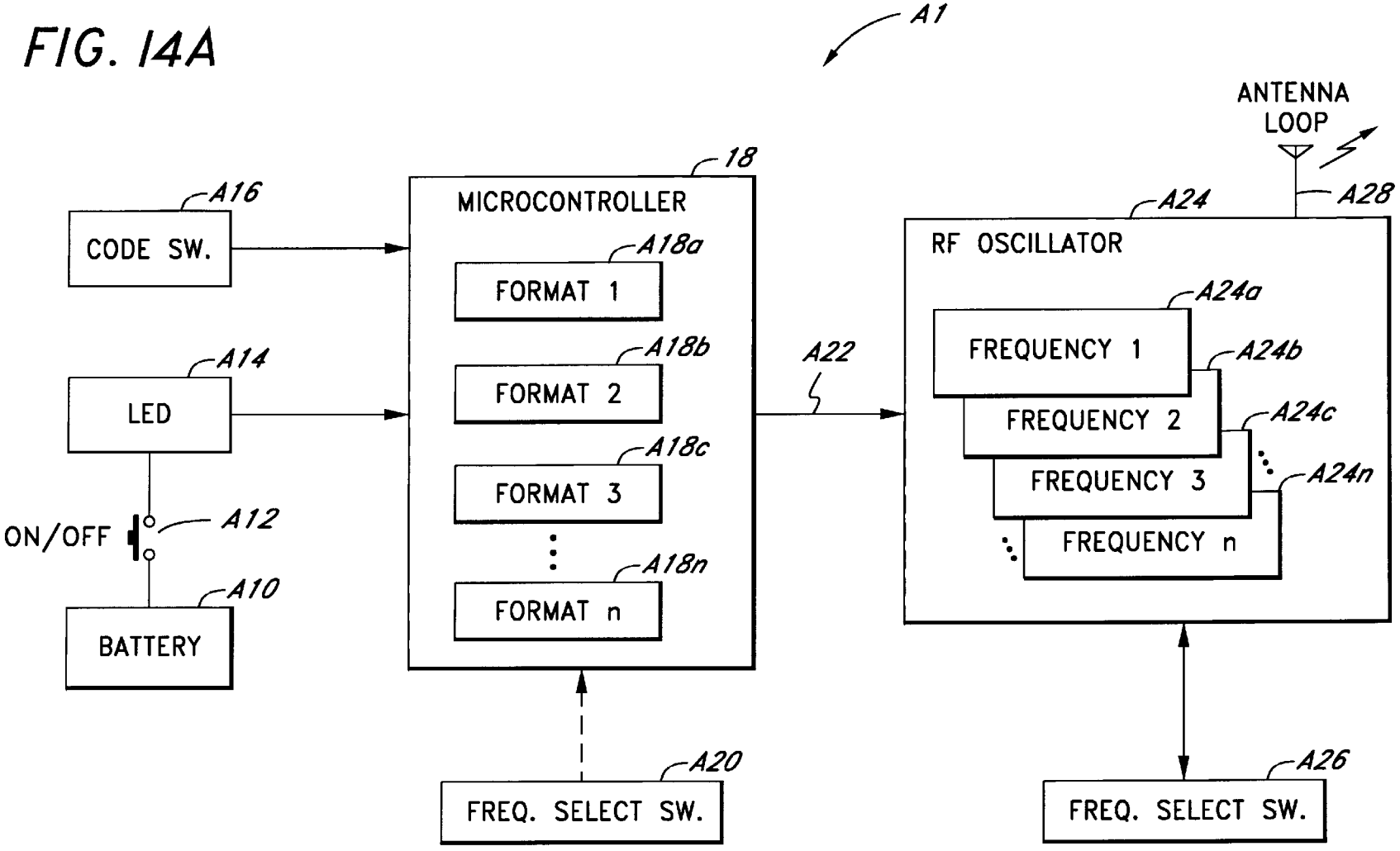
FIG. 14A is a schematic block diagram of the transmitter A1 of FIG. 13A.
Figure 16A:
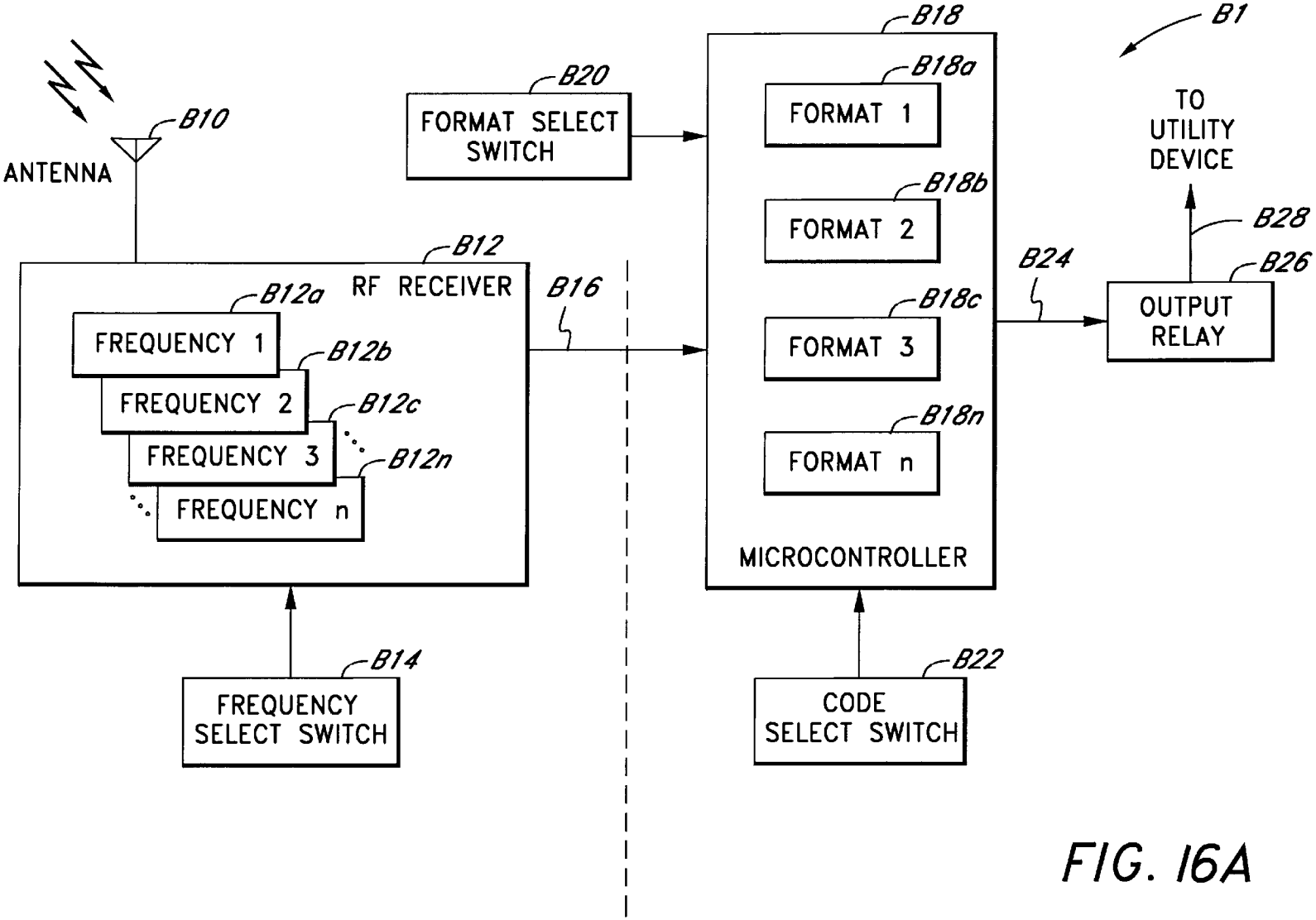
FIG. 16A is a schematic block diagram of the receiver B1 of FIG. 13B.

The transmitter A1 and receiver B1 typically have a device code (or device address) which is selectable by setting a code select switch A16 or B22 (see FIGS. 14A and 16A respectively). In one embodiment, the code select switch A16 or A22 each has a plurality of corresponding switches such as DIP switches. Identical device codes are required for communication between a transmitter A1 and a receiver B1. Communication between the transmitter A1 and B1 is accomplished according to a specific data transmission format which typically is unique to devices provided by the manufacturer of the specific transmitter-receiver system. This data transmission format is implemented with ASIC-type encoders and decoders which can transmit and receive the data format(s) implemented in the ASIC circuitry. The data transmission format(s) may also be implemented using a microcontroller and/or encoders and decoders which can transmit and receive the data format(s) implemented in a microcontroller. In one embodiment, the transmitter A1 sends out the device code in a plurality of formats, one of which matches the format of receiver B1. In this manner, the transmission format of A1 does not have to be manually set to match that of receiver B1.

FIG. 14A is a schematic block diagram of the transmitter A1 of FIG. 13A. The transmitter A1 comprises a battery A10, which supplies current and voltage to circuits within the transmitter A1 when the transmitter A1 is actuated via switch A12. In particular, when the switch A12 is depressed, current is provided from the battery A12 to a light emitting diode (L.E.D.) A14, which lights up, indicating to the user that the transmitter A1 is powered on. The battery A10 also supplies current to a microcontroller A18. The device code of the transmitter A1 is selectable by setting the code switch A16. In one embodiment, the code select switch A16 is a Dual-In-Line Package (DIP) switch.

A format select switch A20 is used for selection of a plurality of data transmission formats A18*a*, A18*b*, A18*c* or A18*n*, of data or any combination of the data transmission formats A18*a*, A18*b*, A18*c*, . . . , and A18*n*. Such transmission of the signal circumvents the need for the user to determine and to manually set the code switch A16 to switch setting that matches that of a particular transmission format. In either case, a signal A22 is provided to an oscillator A24, which transmits the signal using one of a plurality of transmission frequencies A24*a*, A24*b*, A24*c*, . . . , or A24*n* through antenna A28. Selection of the transmission frequencies A24*a*, A24*b*, A24*c*, . . . , A24*n* is made via frequency switch A26.

Figure 14B:
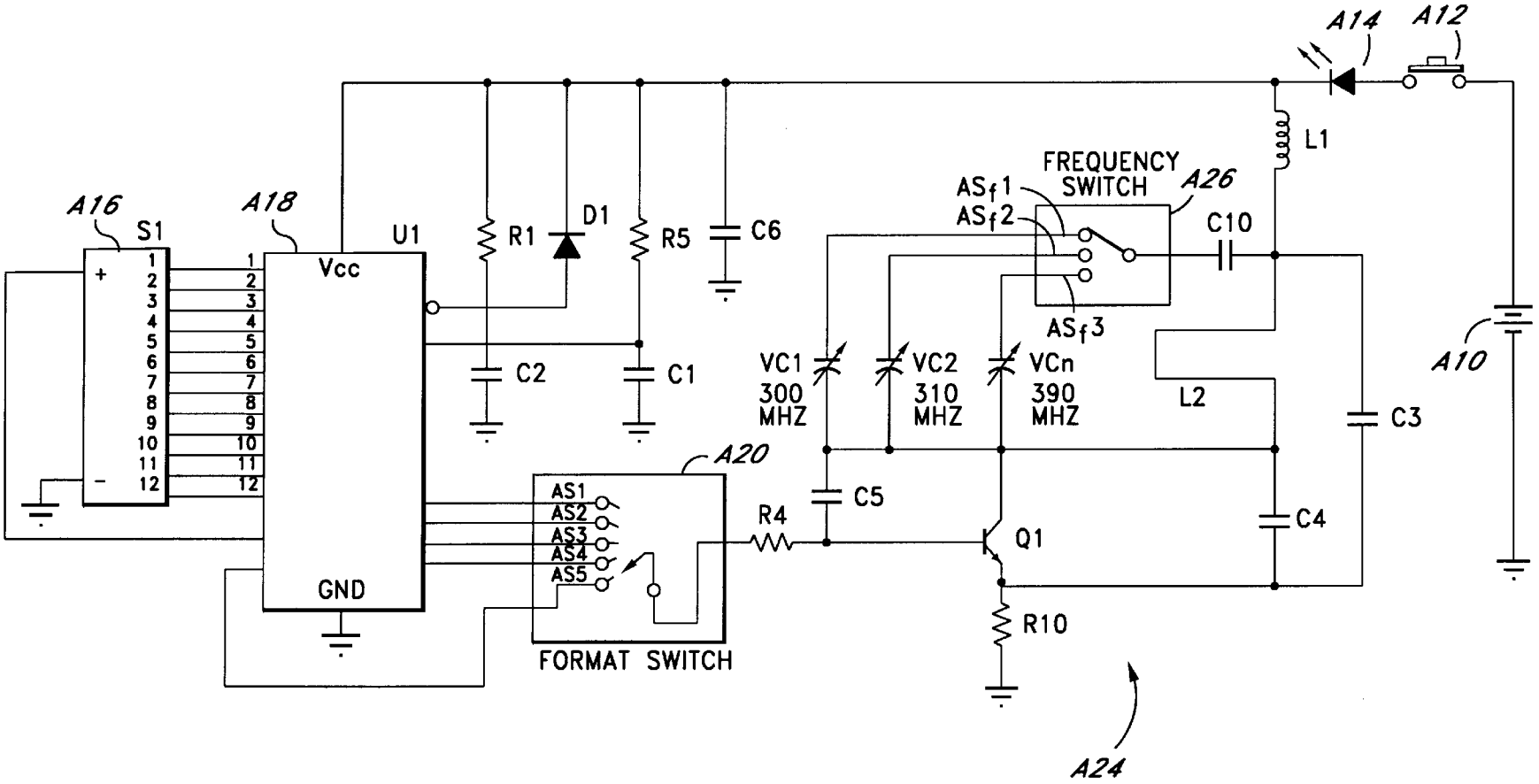
FIG. 14B is a detailed schematic diagram of the transmitter A1 of FIG. 14A.

FIG. 14B is a detailed schematic diagram of the transmitter of FIG. 14A. Closure of the switch A12 applies power from the battery A10 to the transmitter circuitry. An LED A14 or similar device is coupled to the circuit to indicate that the switch A12 has been closed and that the battery A10 is operative. The code switch A16, such as a DIP switch, functions as the device code select switch for reading the device code into the microcontroller A18. The microcontroller A18 interrogates the positions of the code switch A16 by multiplexing output signals from ports 1–12 or the code switch A16, and receiving these signals over its input ports 1–12.

Microcontroller A18 is programmed to encode output data in one of a plurality of formats, or in a combination of formats. The control input selecting the appropriate data transmission format is provided by the format select switch A20. The output of the format select switch A20 is coupled to input ports of the microcontroller A18, for interrogation by the microcontroller A18. The resulting control input status provided by the format select switch A20 selects the appropriate encoding processes in the microcontroller A18 for generating an output signal corresponding to the selected data transmission format.

Figure 14C:
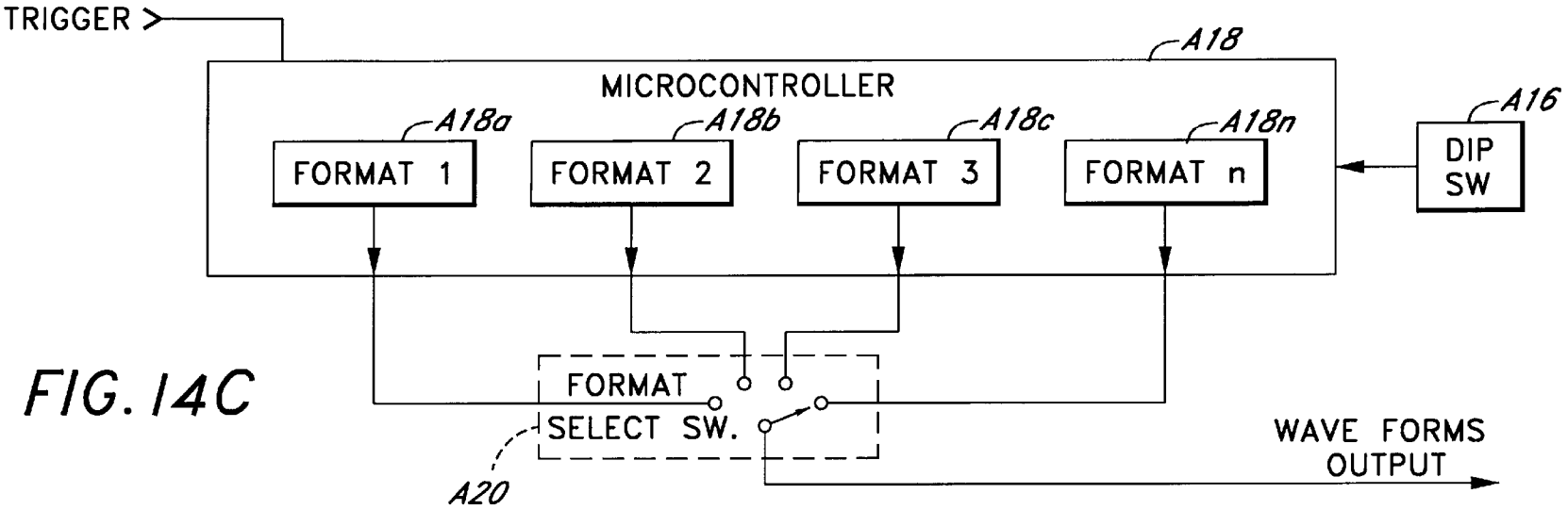
FIG. 14C is a detailed block diagram illustrating one embodiment of the microprocessor A18 and the format select switch A20 of FIG. 14B.

FIG. 14C is a detailed block diagram illustrating one embodiment of the microcontroller A18 and the format select switch A20 of FIG. 14B. In this embodiment, the microcontroller A18 is preprogrammed to store a plurality of code formats A18*a*, A18*b*, A18*c*, . . . , A18*n*, such as those shown in FIGS. 15A–D. The format select switch A20 is used to select any one of the data transmission formats A18*a*, A18*b*, A18*c*, . . . , A18*n* for transmitting the signal A22. In one embodiment, the switch settings AS1, AS2, AS3 and AS4 correspond to the transmission formats A18*a*, A18*b*, A18*c*, and A18*n*.

Figure 14D:
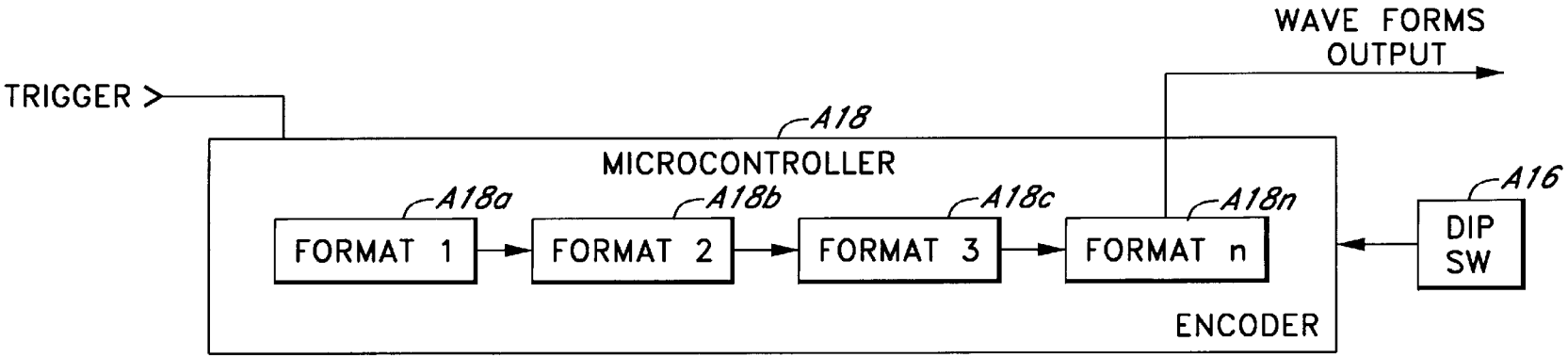
FIG. 14D is a detailed block diagram of a second embodiment of the microprocessor A18 of FIG. 14B.
Figures 15A, 15B, 15C, 15D:
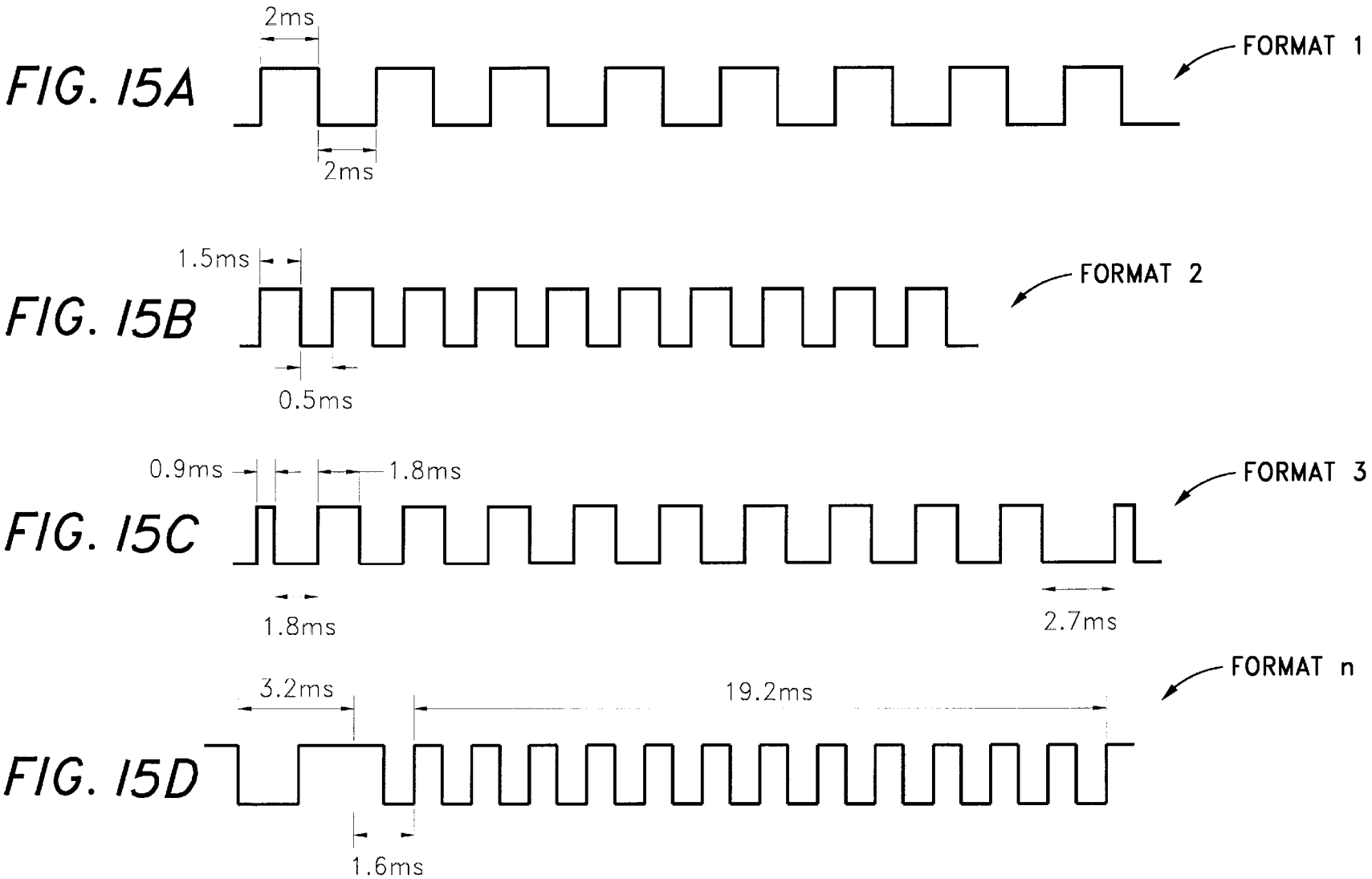
FIGS. 15A, 15B, 15C and 15D illustrate exemplary code formats utilized by the transmitter A1 of FIGS. 14A–14C.

FIG. 14D is a detailed block diagram of a second embodiment of the microcontroller A18 of FIG. 14B. In this embodiment, the microcontroller A18 is preprogrammed to transmit the signal A22 using a plurality of transmission formats, selected from any combination of the stored transmission formats A18*a*, A18*b*, A18*c*, . . . , A18*n*. In one embodiment, the switch setting AS5 of format select switch A20, provides the plurality of transmission formats A18*a*, A18*b*, A18*c*, . . . , A18*n* (or any combination thereof). Alternatively, the microprocessor A18 may be programmed to transmit the coded signal in the plurality of transmission formats A18*a*, A18*b*, A18*c*, . . . , A18*n* (or any combination thereof) without the use of a format select switch A20. The advantage of such a feature includes circumventing the need for the user to learn and to manually set the format selection switch A20 to a switch setting AS1, AS2, AS3, AS4 or AS5 corresponding to a particular transmission frequency.

Referring now to FIG. 14B, the output signal, in the form of a pulse train (i.e., serial data) having the selected format (s) and containing the appropriate device code, is then coupled from the terminal connected to the selected switch setting AS1, AS2, AS3, AS4 or AS5, to the base of transistor Q1 to turn the oscillator A24 on or off. The pulse train selectively activates the oscillator A24 to provide a transmitted signal A30 through antenna L2. The transmitted output of the oscillator is a signal A30 with the selected data transmission format A18*a*, A18*b*, A18*c*, A18*n* (or a combination thereof) at a selected frequency of the oscillator A24. The output frequency generated across the inductor L1 is a function of the capacitance VC1, VC2 or VCn connected in series with the inductor L1. In particular, one of three switch settings $AS_f1$, $AS_f2$ or $AS_fn$ of the frequency switch A26 is used to selected one of three transmission frequencies provided via capacitors VC1, VC2 or VCn, respectively.

FIGS. 15A, 15B, 15C and 15D illustrate exemplary data transmission formats utilized by the transmitter of FIGS. 14A and 14B. The data transmission formats shown are typical formats utilized in communications between a transmitter and a receiver. As is apparent to one of ordinary skill in the art, any known data transmission format, such as a frequency shift keying (FSK) format, a pulse amplitude modulation (PAM) format, or a pulse code modulation (PCM) format may be used. In accordance with the present invention, the transmission signal A30 may be transmitted using a combination of any data transmission formats A18*a*, A18*b*, A18*c*, . . . , A18*n* (FIG. 14A).

FIG. 16A is a schematic block diagram of the receiver of FIG. 13B. Upon receiving a signal, the receiving antenna B10 provides the received signal A30 to a frequency oscillator B12 that is configured to receive any one of plurality of frequencies B12*a*, B12*b*, B12*c*, . . . , B12*n*. The transmission frequency of the receiver B1 may be selected using the switch settings $BS_f1$, $BS_f2$, $BS_f3$ or $BS_fn$ of frequency select switch B14. If the received signal matches the reception frequency of the receiver B1, it is provided to the microcontroller B18, which is preprogrammed to receive signals in one of a plurality of code formats B18*a*, B18*b*, B18*c*, . . . , B18*n*. A format select switch B20 having a plurality of switch settings BS1, BS2, BS3 and BS4 is used to provide selection of the transmission formats B18*a*, B18*b*, B18*c*, . . . , B18*n*. A code select switch B22 is used to specify a device code for the receiver B2. If the device code of the received signal matches the device code of the receiver B1, the microcontroller B18 generates a corresponding signal to an output relay B26, which then generates a corresponding signal to a utility device.

Figure 16B:
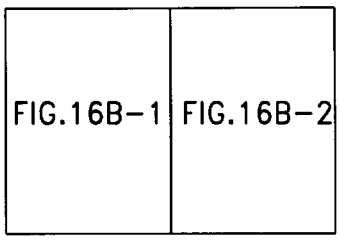
FIG. 16B is a detailed schematic diagram of the receiver B1 of FIG. 16A.
Figures 1, 16B:
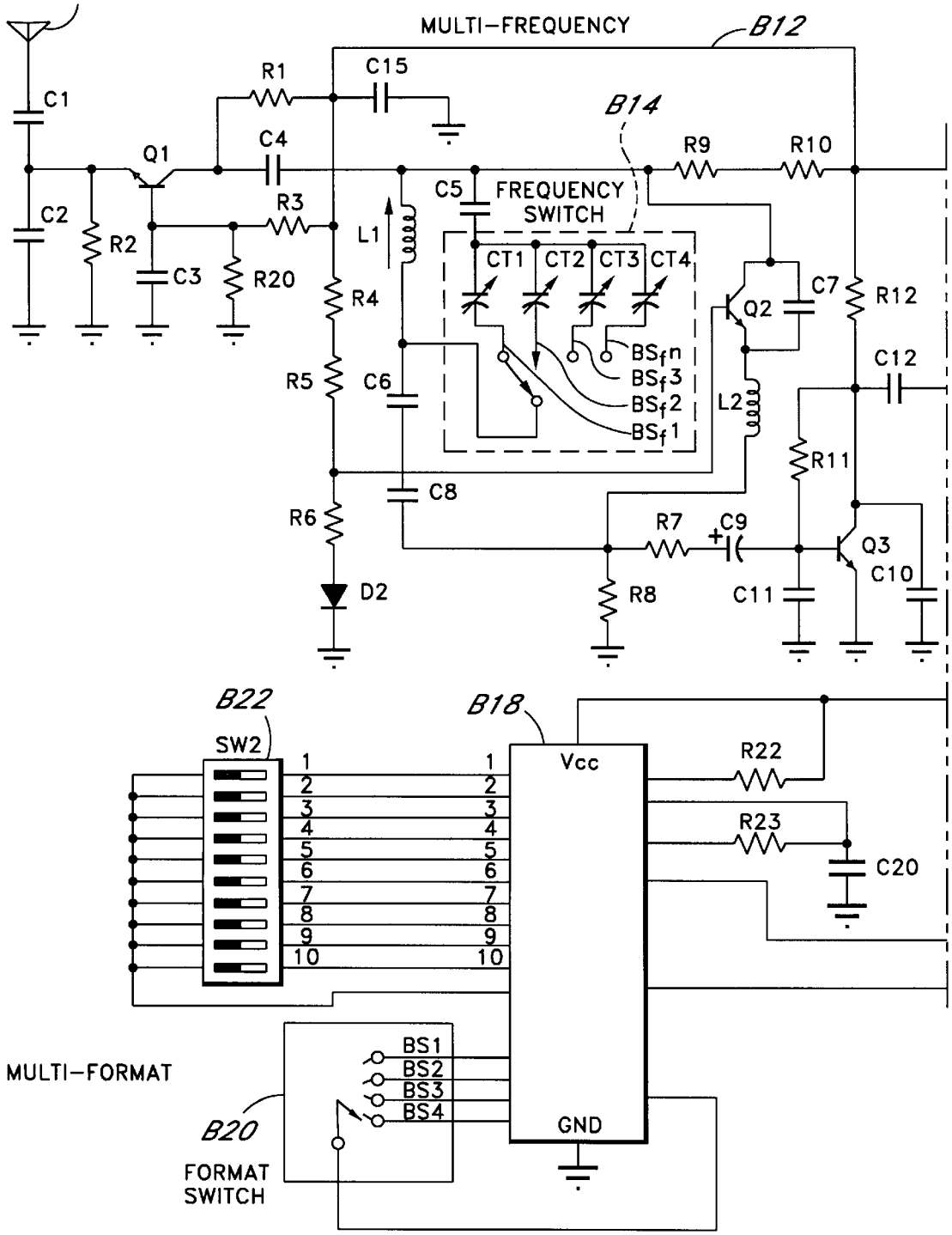
Figures 2, 16B:
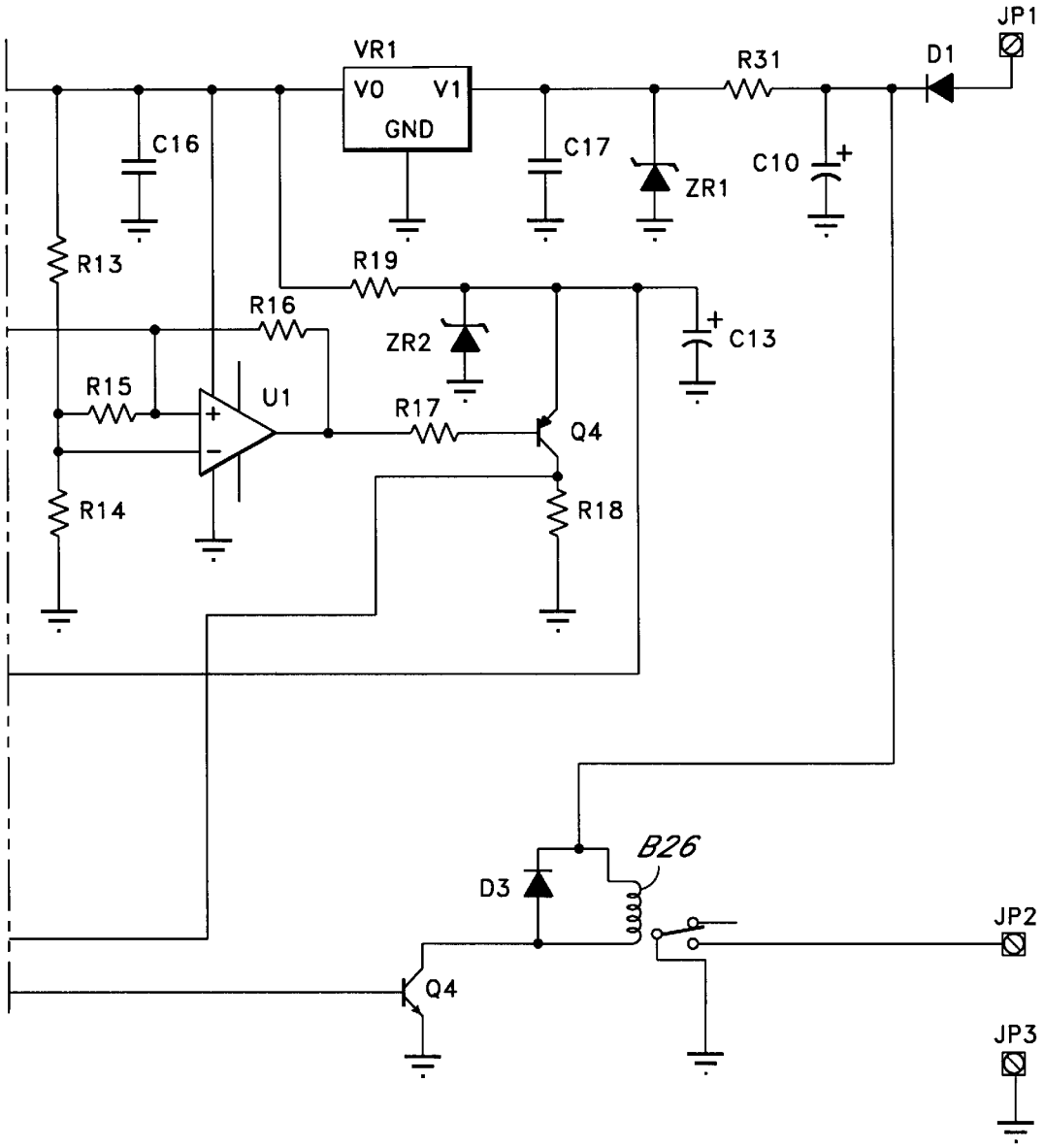

FIG. 16B is a detailed schematic diagram of the receiver B1 of FIG. 16A. The receiver B1 comprises a power supply which includes a voltage regulator VR1. The regulator VR1 is connected to a suitable power source at terminal JP1. The receiver B1 also comprises an antenna B10 which is connected to one stage of an RF amplification circuit which includes transistor Q1, capacitors C1, C2, C3, C4 and resistors R1, R2, R3 and R20. The RF amplification circuit is connected to an oscillator B12 which includes transistor Q2, inductor L1, capacitors C5, C6, C7, C8 and C9. A frequency selection switch B14 provides selection of the frequency of the oscillator B12. In one embodiment, the frequency selection switch B14 has four switches $BS_f1$, $BS_f2$, $BS_f3$ and $BS_fn$, each of which is coupled to a capacitor CT1, CT2, CT3 and CTn. The frequency selection switch B14 provides for the selection of one of four oscillator frequencies by implementing the corresponding capacitors CT1, CT2, CT3 or CTn in the oscillator B12. It is apparent to one of ordinary skill in the art that fewer or a greater number of switches and corresponding capacitors may be provided for frequency selection. The oscillator B12 is connected to a demodulating circuit that includes transistor Q3, for amplification and for demodulation of the output signal from the oscillator B12.

The demodulated signal is provided through comparators U1 and U2 to the input of a microcontroller B18. The data input signal to the microcontroller B18 is a train of pulses having a specific format as generated by the transmitter A1. The microcontroller B1 is also coupled to a code switch B22, such as a DIP switch, for reading a device code into the microcontroller B18. In particular, the microcontroller B18 interrogates the positions of the code switch B22 by multiplexing output signals from output ports 1–10. It is apparent to one of ordinary skill in the art that additional switches may be utilized in the code switch B22 to provide larger or more complicated codes.

The microcontroller B18 is also programmed to decode the received pulse train which contains the device code of the transmitter A1, compare the decoded device code of the transmitter A1 with the device code of the receiver B1 as set by the individual positions of the code switch B22, and provide a data output signal at the DATA terminal if the device code of the transmitter A1 and that of the receiver B1 are identical. When the device codes are identical, a data output signal from the microcontroller B18 is coupled to activate transistor Q5.

Figure 16C:
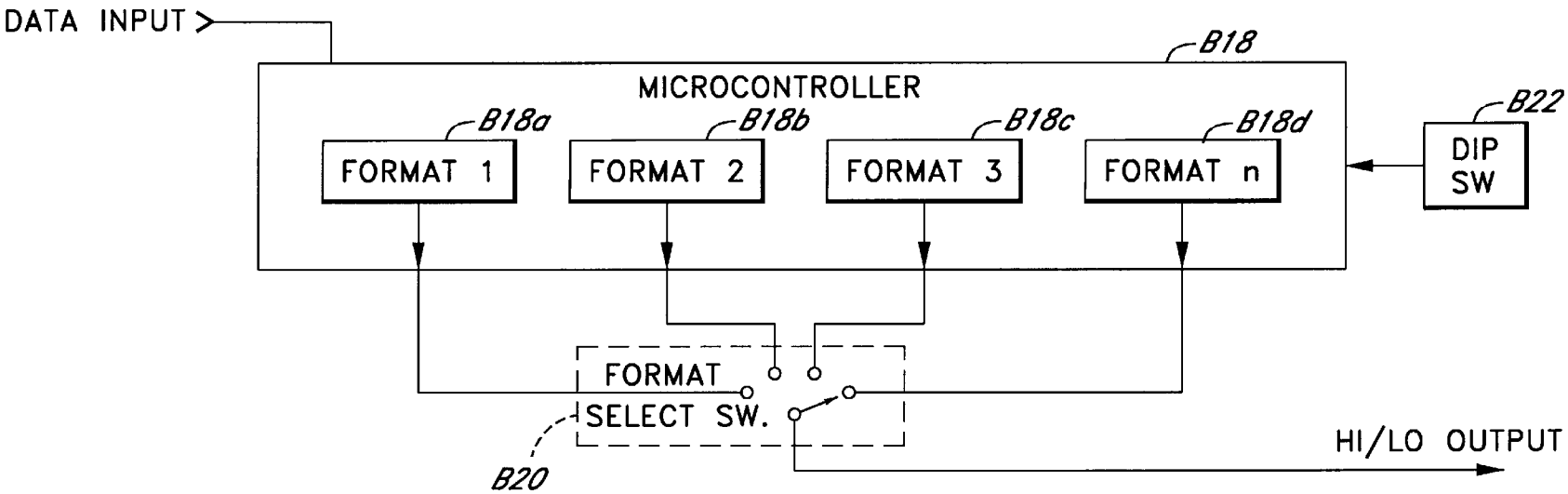
FIG. 16C is a detailed block diagram illustrating one embodiment of the microprocessor B18 of FIG. 16B.

The microcontroller B18 may be programmed to decode pulse trains having multiple data transmission formats. Control inputs which are provided to the microcontroller B18 select decoding processes that are appropriate for the format of the incoming signal. In the schematic of FIG. 16B, the format select switch B20 facilitates the selection of one out of four formats. The microcontroller B18 interrogates its input ports coupled to the switches BS1, BS2, BS3 and BS4 of the format switch B20 to determine the selected format. The resulting control input status selects the appropriate processes in the microcontroller B18 for decoding the received signal. FIG. 16C is a detailed block diagram illustrating one embodiment of the microcontroller B18 of FIG. 16B. The microcontroller B18 is preprogrammed to store a plurality of data transmission formats B18*a*, B18*b*, B18*c*, . . . , B18*n*, such as those shown in FIGS. 15A–D. A format select switch B20 is used to provide selection of the transmission formats B18*a*, B18*b*, B18*c*, . . . , B18*n*.

With reference to FIG. 16B, when transistor Q5 is turned on, the receiver circuit is completed through the coil of relay B26. Activation of the relay B26 moves the armature of the relay B26 and connects the output terminal JP2 to ground, thereby applying a voltage between the input terminal JP1 and terminal JP2. This voltage is thus available to actuate the operation of a utility device such as a garage door opening system.

Figure 17A:
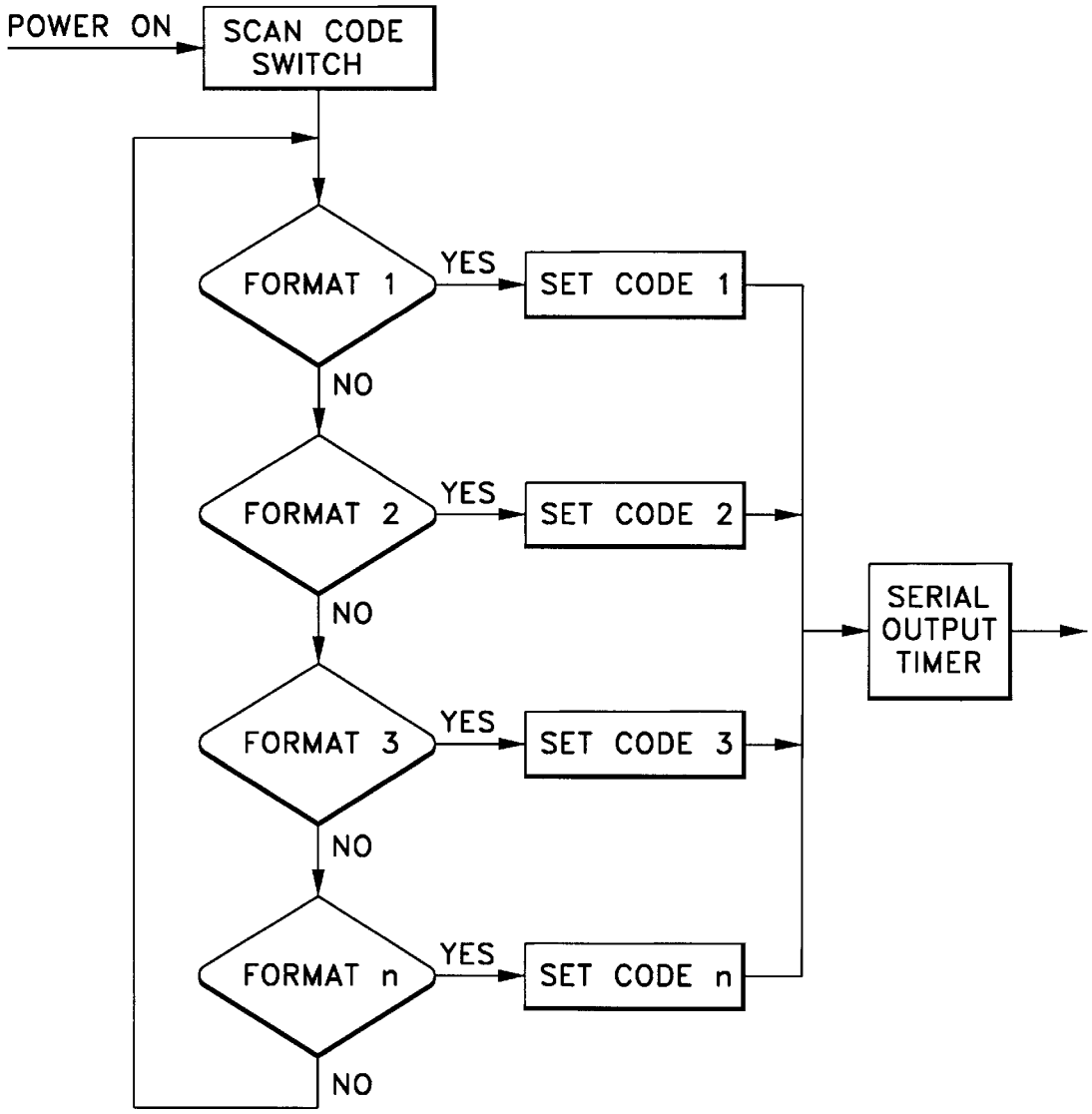
FIG. 17A is a flow chart illustrating one embodiment of the process flow of the transmitter A1 of the present invention.

FIG. 17A is a flow chart illustrating the process flow of a transmitter of the present invention, where one of a plurality of transmission formats has been selected. The microcontroller A18 is a typical microcontroller and may be represented by the microcontroller shown in FIG. 10. With reference to FIGS. 10 and 17A, the transmitter microcontroller A18 operates as follows. Upon the application of power, the program counter 1014 executes instructions stored in ROM 1022 to scan the logic blocks of the key-out unit 1016 and the key-in unit 1018 to determine external inputs to the microcontroller A18. That is, the chosen device code and the selected data transmission format as provided by code switch A16 and format switch A20 respectively, are read. This data is stored in RAM 1020.

Next, the program counter 1014 fetches the next group of sequential instructions in ROM 1022 to determine the format of the inputted data. This is accomplished by comparing the fetched data in the ROM instruction with the data stored in the RAM 1020. Both sets of data are transferred to the ALU 1012 for data comparison. Once the selected format is determined, a new digital command is written back to a location in RAM for outputting. The program counter 1012 then fetches the next group of ROM instructions which transfer the command to the timing and control unit for actual outputting of the serial pulse train.

Figure 17B:
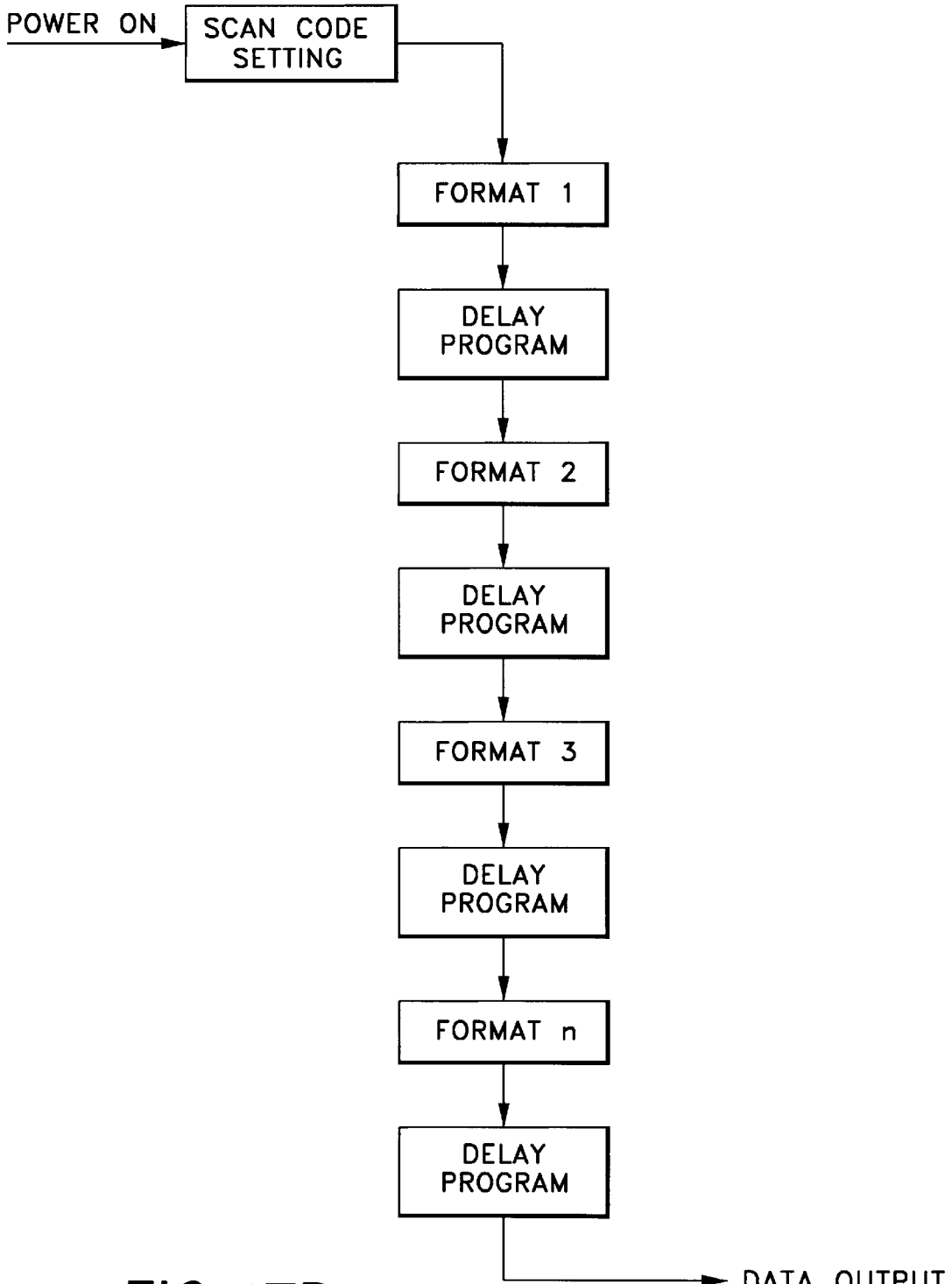
FIG. 17B is a flow chart illustrating a second embodiment of the process flow of the transmitter A1 of the present invention.

FIG. 17B is a flow chart illustrating the process flow of a transmitter of the present invention, where a combination of transmission formats has been selected. With reference to FIGS. 10 and 17B, the transmitter microcontroller A18 operates as follows. Upon the application of power, the program counter 1014 executes instructions stored in ROM 1022 to scan the logic blocks of the key-out unit 1016 and the key-in unit 1018 to determine external inputs to the microcontroller A18. That is, the chosen device code and the selected data transmission formats as provided by code switch A16 and format select switch A20 respectively, are read. This data is stored in RAM 1020.

Next, the program counter 1014 fetches the next group of sequential instructions in ROM 1022 to determine the format of the inputted data. This is accomplished by comparing the fetched data in the ROM instruction with the data stored in the RAM 1020. Both sets of data are transferred to the ALU 1012 for data comparison. Once the selected format is determined, a new digital command is written back to a location in RAM for outputting. In the present case, all four formats A18*a*, A18*b*, A18*c* and A18*n* have been selected via selection, for example, of switch setting AS5 in the format selection switch A20. It is apparent to one of ordinary skill in the art that any combination of the data transmission formats A18*a*, A18*b*, A18*c*, . . . , A18*n* may be selected. The program counter 1012 then fetches the next group of ROM instructions which transfer the command to the timing and control unit for actual outputting of plurality of serial pulse trains each of which has a different transmission format. Each pulse train is transmitted after a short delay, following a prior pulse train.

Figure 18:
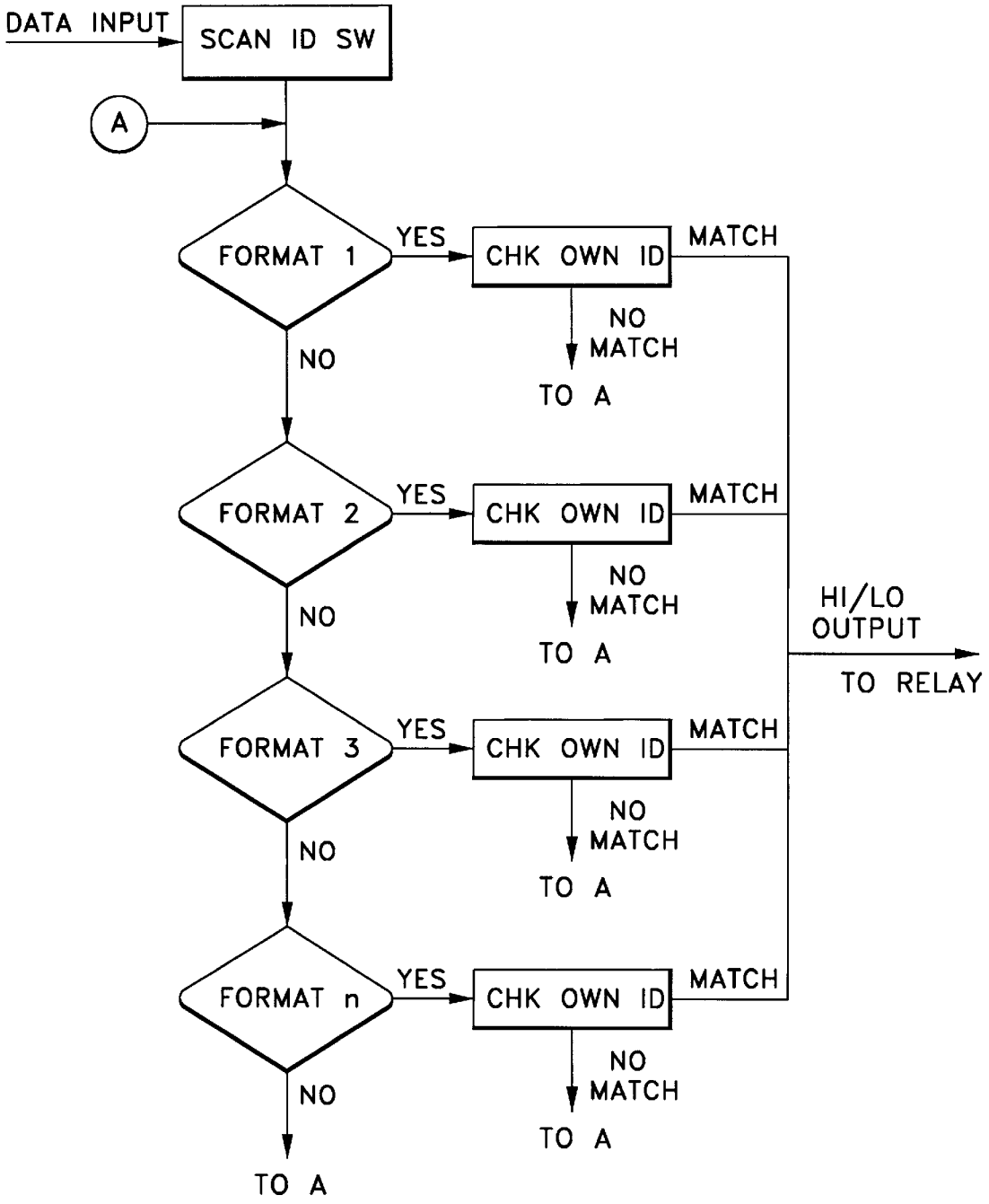
FIG. 18 is a flow chart illustrating the process flow of the receiver B1 of the present invention.

FIG. 18 is a flow chart illustrating the process flow of a receiver of the present invention. The microcontroller B18 in the receiver B1 operates in a similar manner to the transmitter microcontroller A18 in decoding the received signal. Upon receiving a data signal, the program counter 1014 fetches instructions stored in ROM 1022 to instruct key-in and key-out blocks 1018 and 1016 respectively, to scan the settings of the code switch B22 and format switch B20. The retrieved information is stored in designated locations in RAM 1020. Upon validation of the serial data, the data is stored in RAM 1020 for further processing to determine its device code and format information. The next set of instructions directs the microprocessor B18 to transfer the serial data stored in RAM 1020 to the ALU 1012 for comparison.

If the received device code matches the receiver's device code (as provided by setting code switch B22), and if the received data has a format that matches the receiver's format (as provided via format switch B20), the ALU 1012 sends a unique data bit to the RAM 1020 to indicate a match. The next sequential instruction from ROM 1022 transfers this unique data bit to the timing and control block, which outputs this signal to drive the relay control B26.

While the preceding description has been directed to particular embodiments, it is understood that those skilled in the art may conceive modifications and/or variations to the specific embodiments and described herein. Any such modifications or variations which fall within the purview of this description are intended to be included therein as well. It is understood that the description herein is intended to be illustrative only and is not intended to limit the scope of the invention. Rather the scope of the invention described herein is limited only by the claims appended hereto.

What is claimed is:

1. In a transmitter-receiver system in which a transmitter transmits at least two coded signals to a receiver, said transmitter comprising:

a plurality of switches that are selectable to provide an address;

a microcontroller coupled to said plurality of switches, said microcontroller generates a first and a second coded signals in a first and a second data transmission formats, said first and said second transmission formats being provided using different modulation techniques, each said first and second coded signals including the selected address; and a circuit coupled to said microcontroller, said circuit having a plurality of frequency switches that are selectable to provide one of a plurality of transmission frequencies, said circuit serially transmits said first and second coded signals at a selected one of a plurality of transmission frequencies.

2. The transmitter of claim 1, wherein said plurality of switches are switches located within a dual inline package switch.

3. The transmitter of claim 1, wherein the microcontroller further generates a third output signal representative of a third data transmission format, said third data transmission format being provided using a different modulation technique from said first and said second data transmission formats, said first, second and third output signals being transmitted serially.

4. The transmitter of claim 3, wherein said third output signal includes the selected address and wherein said circuit transmits said third output signal at the selected one of a plurality of transmission frequencies.

5. The transmitter of claim 1, wherein said circuit comprises:

an oscillator circuit that provides a selected one of a plurality of transmission frequencies; and an antenna for transmitting the coded signal at the selected transmission frequencies.

6. The system of claim 1, wherein said different modulation techniques are selected from a group consisting of: frequency shift keying, pulse amplitude modulation and pulse code modulation.

7. A method of transmitting at least two coded signals, comprising the steps of:

providing a plurality of switches that are selectable to provide an address;

providing a first and a second output signals in a first and a second data transmission formats respectively, said first and said second data transmission formats being provided using different modulation techniques;

generating a first and second coded signals in the first and second data transmission formats based on said first and second output signals, each said coded signals including the selected address;

selecting one of a plurality of transmission frequencies; and serially transmitting said first and said second coded signals at the selected one of a plurality of transmission frequencies.

8. The method of claim 7, wherein in the step of providing a plurality of switches, said switches are located within a dual inline package switch.

9. The transmitter of claim 7, further comprising the step of transmitting a third output signal in a third data transmission format said third data transmission format provided using a different modulation technique from said first and said second data transmission formats, wherein said coded signal in said third data transmission format is transmitted serially after said first and said second signals.

10. The method of claim 7, wherein said different modulation techniques are selected from a group consisting of: frequency shift keying, pulse amplitude modulation and pulse code modulation.

* * * * *